US008177597B2

(12) United States Patent
Kolb

(10) Patent No.: US 8,177,597 B2
(45) Date of Patent: May 15, 2012

(54) METHOD FOR CONSTRUCTING A LAMP FOR RADIATING A WARNING SIGNAL

(76) Inventor: Klaus Kolb, Gefrees (DE)

( * ) Notice: Subject to any disclaimer, the term of this patent is extended or adjusted under 35 U.S.C. 154(b) by 0 days.

(21) Appl. No.: 12/927,324

(22) Filed: Nov. 12, 2010

(65) Prior Publication Data

US 2011/0107587 A1 May 12, 2011

Related U.S. Application Data

(63) Continuation of application No. 11/630,867, filed as application No. PCT/EP2005/052764 on Jun. 15, 2005, now abandoned.

(30) Foreign Application Priority Data

Jun. 22, 2004 (DE) ..... 20 2004 009 781 U
Jan. 20, 2005 (DE) ..... 20 2005 000 916 U

(51) Int. Cl.
*H01J 9/00* (2006.01)

(52) U.S. Cl. ..... 445/22; 362/327

(58) Field of Classification Search ..... 445/22; 362/35, 327, 170
See application file for complete search history.

(56) References Cited

U.S. PATENT DOCUMENTS 1,888,995 A 11/1932 Matter
3,117,302 A 1/1964 Cardarelli et al.
3,271,735 A 9/1966 Gosswiller
3,784,809 A 1/1974 Smith
4,124,880 A 11/1978 Dart et al.
5,694,112 A 12/1997 Vannrox et al.
6,048,083 A 4/2000 McDermott
6,667,582 B1 12/2003 Procter
7,181,378 B2 * 2/2007 Benitez et al. ..... 703/2
7,503,669 B2 3/2009 Rizkin et al.
2002/0122309 A1 9/2002 Abdelhafez et al.
2003/0072150 A1 4/2003 Rizkin et al.

FOREIGN PATENT DOCUMENTS

DE 203 05 625 7/2003

OTHER PUBLICATIONS

International Search Report in PCT/EP2005/052764 dated Nov. 22, 2005; 3 pgs.

* cited by examiner

*Primary Examiner* — Anne Hines
(74) *Attorney, Agent, or Firm* — Collard & Roe, P.C.

(57) ABSTRACT

A method for constructing a lamp for radiating a warning signal within a desired polar angular range around a mean polar direction includes the steps of fixing a base body at a mounting location, arranging each of an annular support element having an annular reflector, an inner and an outer annular optical system concentrically around a lamp axis to form an optical arrangement and arranging a plurality of lighting elements on the annular support element in an annular distribution around the lamp axis. The annular reflector, inner annular optical system and outer annular optical system and portions thereof are shaped to reflect and/or direct light radiated by the plurality of lighting elements in such a manner that light emerges from the outer annular optical system in a direction within the desired polar angular range around the mean polar direction.

23 Claims, 18 Drawing Sheets

METHOD FOR CONSTRUCTING A LAMP FOR RADIATING A WARNING SIGNAL

CROSS REFERENCE TO RELATED APPLICATIONS

This application is a continuation and claims priority under 35 U.S.C. §120 of U.S. patent application Ser. No. 11/630,867 filed Mar. 9, 2007, which application is a national stage application under 35 U.S.C. §371 of PCT Application No. PCT/EP05/52764 filed on Jun. 15, 2005, which claims priority under 35 U.S.C. §119 from German Application No. 20 2004 009 781.8 filed Jun. 22, 2004 and from German Application No. 20 2005 000 916.4 filed Jan. 20, 2005. The international application under PCT article 21(2) was not published in English.

BACKGROUND OF THE INVENTION

1. Field of the Invention

The present invention relates to a lamp for radiation of a warning signal in all directions around a lamp axis, with a base body fixable at a mounting location and an optical basic arrangement comprising an annular support element and an inner and outer drum optical system, wherein a number of lighting means is arranged on the support element in annular distribution, each of the lighting means radiates light radially outwardly with respect to the lamp axis in a three-dimensional angular range which, around the lamp axis, covers an azimuth angle substantially smaller than 360 degrees and, relative to the lamp axis, covers a polar angle substantially greater than a desired polar angular range in which the warning signal is to be radiated about a mean polar direction, light (central light) radiated by the lighting means relative to the lamp axis in a central polar angular range containing the mean polar direction passes through the outer drum optical system, and the arrangement of the lighting means on the support element, the arrangement of the support element and the outer drum optical system and the construction of the outer drum optical system are so adapted to one another that the central light radiated from the lighting means is after issue from the outer drum optical system radiated in polar direction within the desired polar angular range.

2. Prior Art

A lamp of that kind is known from DE-U-203 05 625 of the applicant.

The known lamp already works very well. In particular, it combines a relatively simple construction with outstanding water tightness and a high level of mechanical reliability and robustness.

The lighting means of the known lamp are usually 5 millimeter light-emitting diodes which on the basis of an optical system integrated in the light-emitting diodes have a beam opening angle of approximately 30 degrees. A light intensity of the lamp of approximately 150 to 200 candela can usually be achieved with use of light-emitting diodes of that kind.

In order to also satisfy international regulations in the field of air travel, lamps have to attain considerably higher lighting intensities. This cannot be readily managed with conventional light-emitting diodes.

Recently, new high-output light-emitting diodes, which radiate a substantially greater amount of light than the light-emitting diodes used hitherto, are available on the market. These high-output light-emitting diodes have, however, a radiation characteristic of approximately 180 degrees. They thus radiate their light substantially hemispherically. If high-output light-emitting diodes of that kind were to be employed in known lamps a not inappreciable proportion of the light would be radiated outside the desired polar angular range.

A lamp for radiation of a warning signal in all directions around the lamp axis is known from US-A-2003/072150, which comprises a base body fixable at a mounting location and an optical basic arrangement, wherein the optical basic arrangement comprises an annular support element and a drum optical system. A plurality of mounting means is arranged on the support element in annular distribution. The support element carries, inter alia, the drum optical system. Each of the lighting means radiates light with respect to the lamp axis radially outwardly in a three-dimensional angular range which, around the lamp axis, covers an azimuth angle substantially smaller than 360 degrees and, relative to the lamp axis, a polar angle substantially greater than a desired polar angular range in which the warning signal is to be radiated about a mean polar direction. Light (central light) radiated by the lighting means relative to the lamp axis in a central polar angular range containing the mean polar direction passes through the drum optical system. The central light contains light (inner central light) radiated in a polar middle region containing the mean polar direction and light (outer central light) radiated in two polar outside regions each adjoining, in polar direction, the polar middle region on a respective side. The outer central light between entry into the drum optical system and issue from the drum optical system is incident on a drum reflector which is a component of the drum optical system. It is reflected there. After passing through the drum optical system the light still passes through an outer cover, which, however, no longer influences the radiation characteristic of the light. The arrangement of the lighting means and the drum optical system on the support element as well as the construction of the drum optical system (inclusive of the drum reflector) are matched to one another in such a manner that the light is radiated within the desired polar angular range about the mean polar direction already after issue from the drum optical system.

A headlight is known from U.S. Pat. No. 1,888,995. The headlight comprises an inner reflector, an outer reflector and an optical system. The inner reflector is a component of the optical system. A lighting means which substantially radiates light to all sides is arranged on the optical axis of the headlight. Light radiated by the lighting means relative to the optical axis in a central angular range containing the optical axis passes through the optical system without prior incidence on the reflectors. Light radiated by the lighting means in a middle angular region initially enters the optical system, then passes to the inner reflector of the optical system, is reflected there in a direction running substantially parallel to the optical axis and then issues from the optical system. The middle angular range adjoins the central angular range. Light radiated by the lighting means in an outer angular range is initially reflected by the outer reflector in a direction running substantially parallel to the optical axis. It then passes through the optical system. The outer angular range adjoins the middle angular range. The arrangement of the lighting means, reflectors and optical system is so matched to one another that all the light radiated by the lighting means is radiated from the headlight in a small angular range about the optical axis.

SUMMARY OF THE INVENTION

The object of the present invention consists in developing a lamp in which the new high-output light-emitting diodes are efficiently usable.

The object is fulfilled by a lamp in accordance with the invention.

If the arrangement of the lighting means and the drum reflector on the support element and the construction of the drum reflector are adapted to one another in such a manner that the outside light is incident on the inner drum optical system as a light beam parallel or slightly diverging in polar direction a radially relatively compact construction of the lamp is possible.

If the inner drum optical system is constructed in such a manner that the outside light issues from the inner drum optical system as a light beam parallel or slightly converging in polar direction this construction can be of even more compact design.

The inner drum optical system is thus preferably so constructed in an inner middle region in which it is penetrated by the outside light that the polar direction of the outside light is substantially unchanged by it or the outside light is refracted by it towards the mean polar direction.

The inner drum optical system is thus preferably so constructed in an inner inside region in which it is penetrated exclusively by the inner central light that the inner central light also does not intersect the outside light in the outer drum optical system, because the inner central light can thereby be influenced by the outer drum optical system independently of the outside light and also independently of the outer central light.

The inner drum optical system can, for example, be constructed in the inner inside region as a polar-acting convergent lens so that the inner central light is refracted by it towards the mean polar direction.

The outer drum optical system has, for the above-mentioned reasons, an outer inside region in which it is penetrated exclusively by the inner central light. In this outer inside region the outer drum optical system is preferably constructed as a ring of uniform thickness. Alternatively, it can be constructed as a weak polar-acting lens. In that case a construction as a polar-acting divergent lens is preferred. In every case the outer drum optical system should, however, be constructed in such a manner that the inner central light issuing from the outer drum optical system diverges in polar direction, but in that case at most covers the desired polar angular range.

The inner central light should preferably cover at least 80% of the desired polar angular range because a relatively uniform illumination of the entire desired polar angular range then takes place. This is so because the lighting means in fact radiate their light in a large three-dimensional angular range, but the direct radially outward radiation is stronger than the radiation towards the side.

The inner drum optical system is, moreover, preferably so constructed in an inner outside region which is penetrated exclusively by the outer central light that the outer central light is refracted by it towards the mean polar direction. This measure further promotes compactness of the construction of the lamp according to the invention. The corresponding design of the inner drum optical system is possible because this region of the inner drum optical system is not penetrated by other light. Depending on the respective design of the inner drum optical system in the inner outside region, either only the boundary surface of the inner drum optical system towards the outer drum optical system or both the boundary surface towards the lighting means and the boundary surface towards the outer drum optical system can be appropriately adapted.

In order to enable a largest possible flexibility in beam influencing by the outer drum optical system the outer central light, insofar as it derives from the inner outside region, should, after issue from the inner drum optical system, be a light beam substantially parallel or slightly diverging in polar direction.

Preferably, the first outer outside region is formed in such a manner that the outer central light is refracted by it in polar direction towards the mean polar direction so that the outer central light issuing from the outer drum optical system diverges in polar direction, but at most covers the desired polar angular range.

The outer central light deriving from the inner outside region of the inner drum optical system which was penetrated exclusively by the outer central light penetrates the outer drum optical system preferably in a second outer outside region which is penetrated only by the outer central light and not also by the inner central light or by the outside light. The first outer outside region and the second outer outside region are in that case different from one another. Here, too, an individual design of this second outer outside region is thus again possible. In addition, the second outer outside region can therefore be formed in such a manner that the outer central light is refracted by it in polar direction towards the mean polar direction so that outer central light issuing from the outer drum optical system diverges in polar direction, but at most covers the desired polar angular range.

The outer drum optical system has to have a relatively large radial thickness in order to also deflect the outer central light in polar direction completely into the desired polar angular range about the mean polar direction. In order to reduce this thickness it is, for example, possible to construct the outer drum optical system at least in its outer outside regions as a Fresnel optical system.

The outside light penetrates the outer drum optical system preferably in an outer central region which is penetrated only by the outside light and not also by the inner or outer central light, because the outer drum optical system can thereby again be optimised with respect to the outside light independently of the influencing of the inner and/or outer central light for the outside light. The outer drum optical system is for this purpose preferably constructed—analogously to the outer inside region—as a ring of uniform thickness or alternatively as a weak polar-acting lens, wherein construction as a divergent lens is preferred in a given case.

With respect to the design of the lamp in mechanical constructional terms it is preferred that the annular support element consists of an upper part, a lower part and a middle part, the upper part and the lower part are mounted by the middle part at a defined spacing from one another, the upper part and the lower part are annular elements, in particular bodies of rotation, the upper part and/or the lower part has or have a region facing the respective other part and constructed to be reflective, the reflective regions in their totality form the drum reflector and the lighting means are arranged on the center part.

The support element is accordingly of simple construction. Moreover, on assembly of the support element an internal adjustment of the individual elements of the support element necessarily takes place. The adjustment relative to the outer drum optical system and—if the inner drum optical system were not to be similarly mounted by the support element—optionally also relative to the inner drum optical system can be produced by way of setting elements as is described in DE-U-203 05 625 on pages 14 and 15 thereof in conjunction with FIG. 3 thereof.

The inner drum optical system is preferably arranged between the upper part and the lower part, because on the one hand a more compact construction of the lamp is thereby possible and on the other hand less individual components are needed. Moreover, a simple adjustment of the inner drum optical system relative to the support element is thereby possible.

The inner drum optical system is preferably mounted to be floating towards both the upper part and the lower part, because mechanical stresses in the inner drum optical system, such as could otherwise on the one hand influence the optical characteristics of the inner drum optical system and on the other hand also lead to mechanical damage in the inner drum optical system, are thereby avoided.

In the normal case the upper part and the lower part are of identical construction. However, in an individual case it can also be feasible to construct the upper part and lower part to be different from one another. In particular, in an individual case it can be useful for selective influencing of the radiation characteristic to construct only one of the two parts, thus either only the upper part or only the lower part, to be reflective. In this case the other part is preferably constructed to be light-absorbing. For example, in this case the other part can be provided with a light-absorbing coating, in particular anodized to be black. Which of the two parts is then constructed to be reflective and which to be light-absorbing depends on the actual circumstances of the individual case, in particular the desired radiation characteristic.

It can be of advantage to separate the light paths of the individual lighting means from one another in tangential direction and for this purpose to arrange on the support element between each two lighting means a respective separating web which extends in radial direction from the light means to the inner drum optical system. These separating webs are preferably constructed to be light-absorbing. However, with sufficiently more complex design of the separating webs they may also be constructed to be light-reflecting.

If of the upper part and lower part only one of the two parts is constructed to be reflective and the other part is constructed to be light-absorbing, the part of light-absorbing construction preferably has appropriate separating web receiving grooves for reception of the separating webs. The separating webs are preferably retained in the part, which receives them, by a clamping seat and/or are glued and are slightly spaced from the other one of the two parts in axial direction.

If the base body has a support flange and a cover and the optical basic arrangement is disposed between the support flange and the cover, sealing of the lamp is ensured in particularly simple manner.

The support element is preferably electrically insulated from the base body, because then the lamp functions particularly reliably in permanent operation. In order to achieve this electrical insulation, layers consisting of electrically insulating material can, for example, be arranged in both radial direction and axial direction between the support element and the base body. In order, nevertheless, to enable satisfactory dissipation of the loss heat generated by the lighting means in operation of the lamp the following design is preferably provided: the lighting means are thermally coupled by way of the support element to the support flange and/or the cover and cooling bodies by means of which loss heat arising in the lighting means can be delivered to the environment are arranged at the support flange and/or cover.

Lighting means of particular light strength can then be used.

The lighting strength of the lamp according to the invention can be still further increased if the lamp has at least one optical auxiliary arrangement which is constructed similarly to the optical basic arrangement and if the optical arrangements are arranged one above the other as seen in the direction of the lamp axis.

Adjustment of the optical arrangements is carried out in simpler manner if in this case the optical basic arrangement as seen in the direction of the lamp axis is mounted at a defined spacing from the support flange and the optical auxiliary arrangement as seen in the direction of the lamp axis is mounted at a defined spacing from the cover. This applies particularly when a resilient spacer is arranged between the support elements of the optical arrangements.

If at least the outer drum optical systems of the optical arrangements are integrally connected together and are mounted between the support flange and the cover, the constructional format of the lamp according to the invention can be simpler, since then fewer components are needed.

BRIEF DESCRIPTION OF THE DRAWINGS

Further advantages and details are evident from the following description of an example of embodiment in connection with the drawings, in which are schematically shown.

DETAILED DESCRIPTION OF THE DRAWINGS

The lamp according to the invention is basically constructed similarly to the lamp of DE-U-203 05 625. In addition to the following embodiments with respect to the design of the lamp in accordance with the invention, DE-U-203 05 625 may therefore also always be consulted for amplification particularly with respect to the basic format of the lamp in terms of mechanical construction.

The fundamental principles of the lamp of DE-U-203 05 625 are briefly explained again in simplified form in the following in conjunction with FIGS. 1 and 2 insofar as they are-of significance for understanding the present invention. With respect to detail amplifications and detail refinements reference can always be made, as already mentioned, to DE- U-203 05 625 to the extent that the explanations given therein do not conflict with the following description of the lamp according to the invention.

Figure 1:
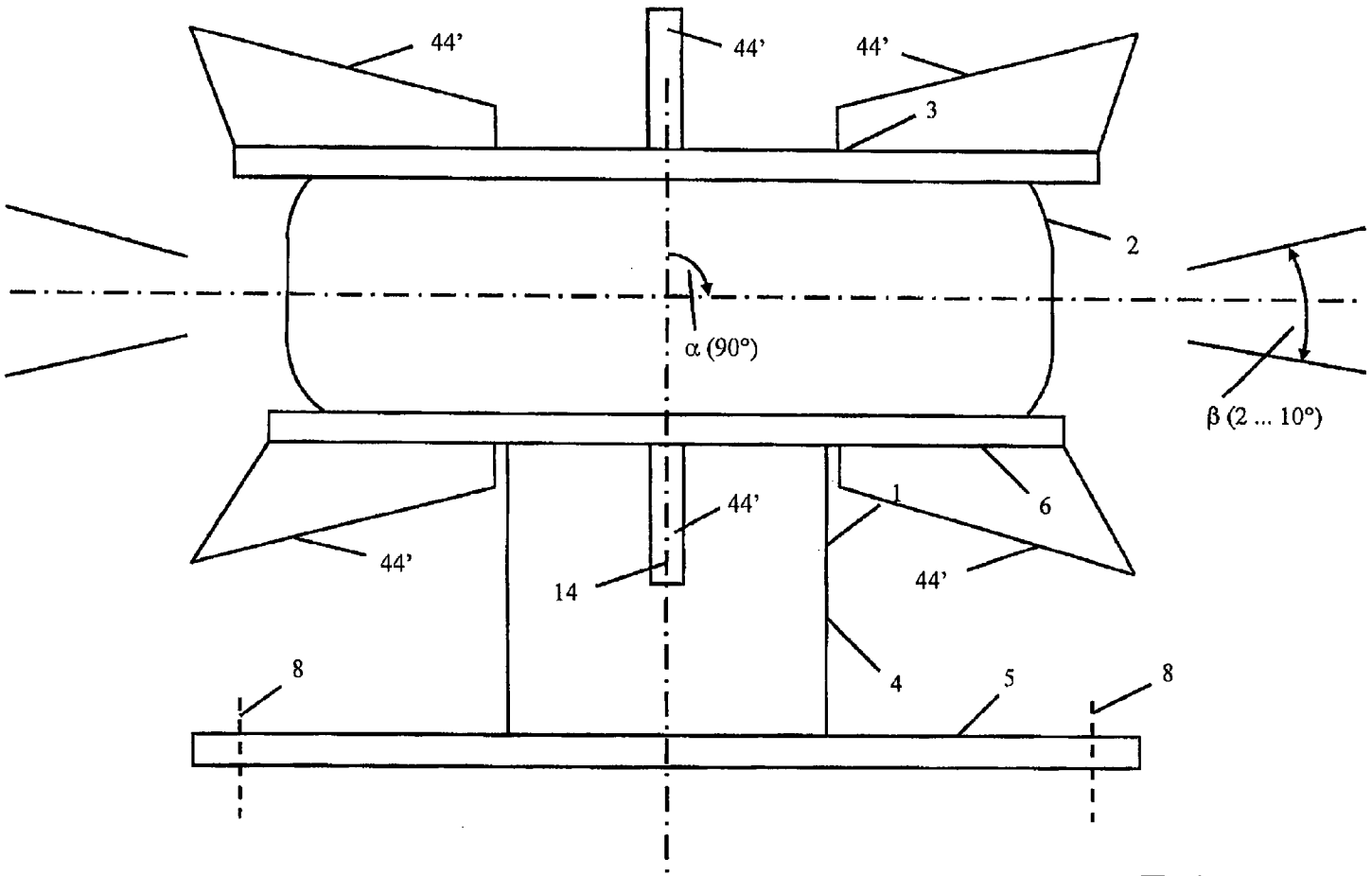
FIG. 1 a lamp in side view.
Figure 2:
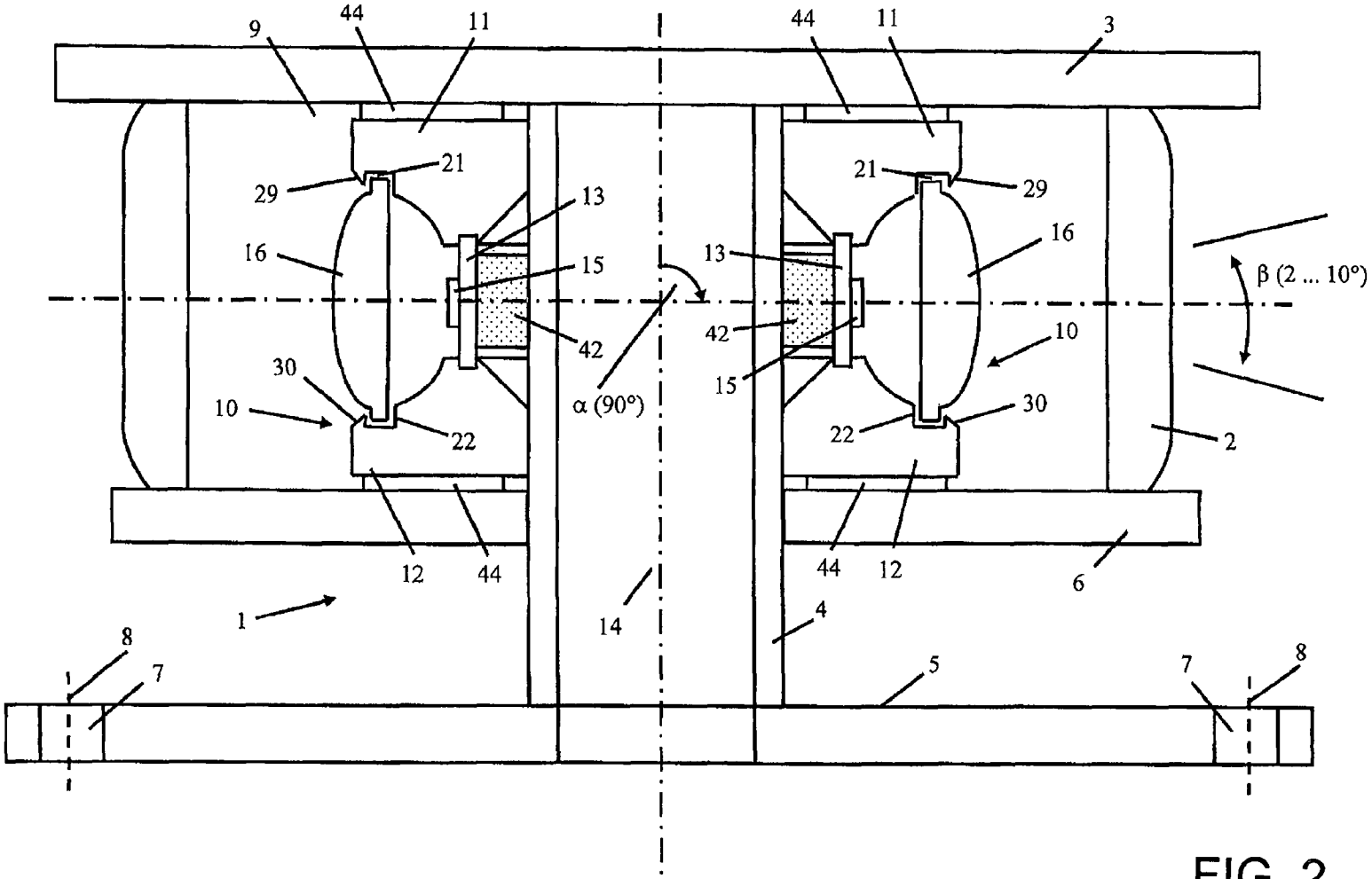
FIG. 2 the lamp of FIG. 1 in section.

According to FIGS. 1 and 2 the lamp according to the invention thus comprises a base body 1, an outer drum optical system 2 and a cover 3. The base body 1 has a central tube 4 at which, in particular, a fixing flange 5 and a support flange 6 are arranged.

The lamp can be fixed at a mounting location by means of the fixing flange 5. For this purpose the fixing flange 5 has bores 7 through which schematically indicated screws 8 can extend.

The support flange 6, central tube 4, cover 3 and outer drum optical system 2 enclose an annular receiving space 9 in which an annular support element 10 is arranged. The support element 10 substantially consists of an upper part 11, a lower part 12 and a middle part 13. A number of lighting means 15 is arranged on the middle part 13 annularly around a lamp axis 14. The lighting means 15 can in principle be any desired lighting means 15. Light-emitting diodes 15, particularly high-output light-emitting diodes 15, are, however, preferred. An inner drum optical system 16 is arranged between the upper part 11 and the lower part 12. The support element 10 thus also carries the inner drum optical system 16. The support element 10 and the drum optical systems 2 and 16 together form an optical basic arrangement.

The lamp is formed to be substantially rotationally symmetrical about the lamp axis 14. In particular, the drum optical systems 2 and 16, the upper part 11 and the lower part 12 are full annular parts. The upper part 11 and lower part 12, possibly also the drum optical systems 2 and 16, are in that case preferably constructed as turned parts. The design of the middle part 13 is discussed in more detail later.

The outer drum optical system 2 has, with respect to the sealing of the receiving space 9, the same function as the drum optical system described in DE-U-203 05 625. It is therefore mounted with respect to the cover 3 and the support flange 6 in the same manner as the drum optical system of DE-U-203 05 625. It preferably consists of polymethylmethacrylate (PMMA, 'Plexiglas').

The optical basic arrangement is thus arranged between the support flange 6 and the cover 3, whereby tightness of the lamp can be ensured in particularly in simple manner.

In addition, the central tube 4 serves the same purpose as the central tube of DE-U-203 05 625. In particular, it also serves for radial fixing of the support element 10 and radial and axial fixing of the cover 3.

Figure 3:
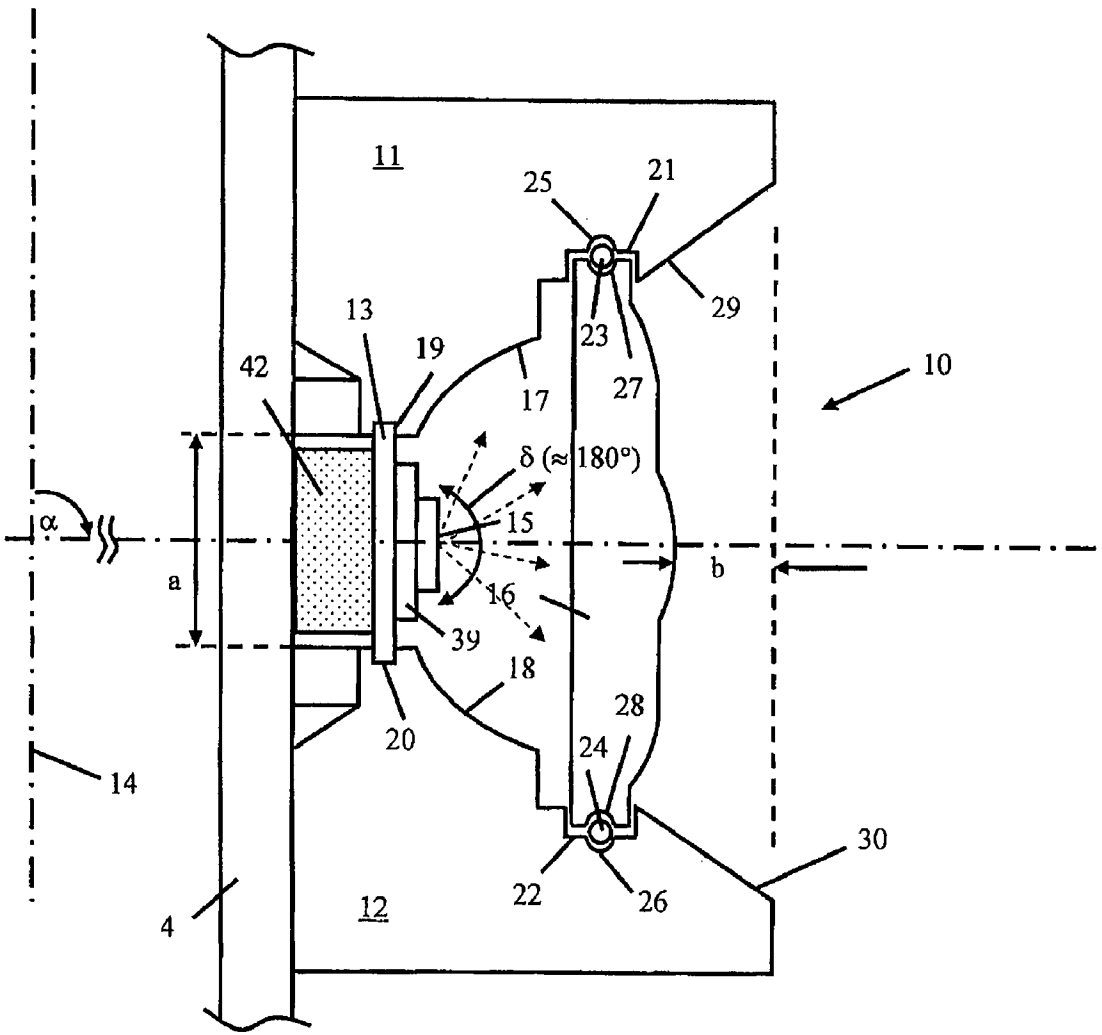
FIG. 3 a detail of FIG. 2.

The support element 10 is—see again FIG. 3 of DE-U-203 05 625—axially adjustable in height. A mean polar direction $\alpha$, in which an optical warning signal is radiated by the lamp, is thereby settable with respect to the lamp axis 14. In general, the angle of the mean polar direction $\alpha$ is 90 degrees. Thus, in the case of vertical arrangement of the lamp axis 14 the lamp radiates this warning signal in all horizontal directions. In principle, the angle of the mean polar direction $\alpha$ could, however, also have a value different from 90 degrees.

The radiation of the warning signal thus takes place all around the lamp axis 14. In polar direction, i.e. with respect to the angle relative to the lamp axis 14, thereagainst the warning signal is radiated only in a desired polar angular range $\beta$ about the mean polar direction $\alpha$. The desired polar angular range $\beta$ is usually only a few degrees, for example 2 to 10 degrees.

As evident particularly clearly from FIG. 3, the upper part 11 and the lower part 12 have a region 17 and a region 18, respectively, each of which faces the respective other part 12 or 11. The mutually facing regions 17 and 18 are constructed to be reflective and form in their entirety a drum reflector 17, 18. They are curved substantially parabolically. The lighting means 15 are preferably arranged at the focal point of the parabola they define. In principle, however, an offset relative to the optical axis would also be possible.

According to the example of embodiment, which illustrates the normal case, both the upper part 11 and the lower part 12 have reflective regions 17 and 18. In this case the upper part 11 and the lower part 12 are of identical construction.

However, in principle it would be possible to construct the upper part 11 and the lower part 12 differently from one another. For example, it is possible to design only one of the two regions 17 and 18 to be parabolic. It would also be possible to construct only one of the regions 17 and 18 to be reflective. This can be useful in an individual case for selective influencing of the radiation characteristic.

If the parts 11 and 12 are constructed differently from one another the part 12 or 11, which is constructed to be non-reflective and/or non-parabolic, is preferably formed to be light-absorbing. In this case, for example, the other part 11 or 12 can be provided with a light-absorbing coating, in particular anodized to be black. Which of the two parts 11 and 12 is in that case constructed to be reflective and which is light-absorbing depends on the actual circumstances of the individual case, particularly the desired radiation characteristic.

The upper part 11 and the lower part 12 have receiving, grooves 19 and 20, respectively, in which they receive the middle part 13. These receiving grooves 19 and 20 are arranged radially inwardly with respect to the upper part 11 and the lower part 12. The middle part 13 is retained in the grooves. The upper part 11 and the lower part 12 are thus held by the middle part 13 at a defined spacing a from one another.

According to FIG. 3 each part 11 and 12 is integrally formed with a reflective region 17 or 18. The reflectivity of the reflective regions 17 and 18 can be achieved in this case in that, for example, the reflective regions 17 and 18 are finely machined, for example polished. Alternatively, however, it would also be possible for the upper part 11 and the lower part 12 to each comprise an integral main body and the reflective regions 17 and 18 to be provided by a reflective coating.

In the case of integral construction of the upper part 11 and lower part 12 the upper part 11 and the lower part 12 preferably consist of metal, particularly of steel, for example high-quality steel or stainless steel. In the instance of provision of a separate reflective coating the upper part 11 and/or the lower part 12 can alternatively consist of metal (for example, again steel) or plastics material. The coating can be, for example, a chrome coating.

As further apparent from FIG. 3 the upper part 11 and the lower part 12 have, for reception of the inner drum optical system 16, further receiving grooves 21 and 22 which, however, are arranged radially outwardly with respect to the upper part 11 and the lower part 12. The upper part 11 and the lower part 12 in the result thereby have a projection b beyond the inner drum optical system 16 so that this system before and also during assembly of the support element 10 is to a limited extent protected radially outwardly against mechanical effects.

The inner drum optical system 16 preferably consists—just as the outer drum optical system 2—of PMMA ('Plexiglas'). According to FIG. 3 it is mounted to be floating towards both the upper part 11 and the lower part 12. The floating mounting of the inner drum optical system 16 towards both the upper part 11 and the lower part 12 is produced in that case according to FIG. 3 by exactly one respective O-ring 23, 24. In principle, however, more than one respective O-ring 23, 24 could also be present.

The upper part 11, lower part 12 and inner drum optical system 16 preferably have, for reception of the O-rings 23 and 24 arranged therebetween, respective O-ring grooves 25 to 28. Good radial fixing of the inner drum optical system 16 within the support element 10 and thus with respect to the lighting means 15 and the drum reflector 17, 18 is thereby produced. The fixing is particularly satisfactory and reliable if the O-ring grooves 25 to 28 have a tight semicircular cross-section, thus in cross-section cover an arc between 90 and 150 degrees.

Moreover, it is apparent from FIG. 3 that the upper part 11 and lower part 12 radially outwardly have chamfers 29 and 30 at mutually facing regions. The upper part 11 and lower part 12 thereby tend away from one another in radially outward direction.

Figure 4:
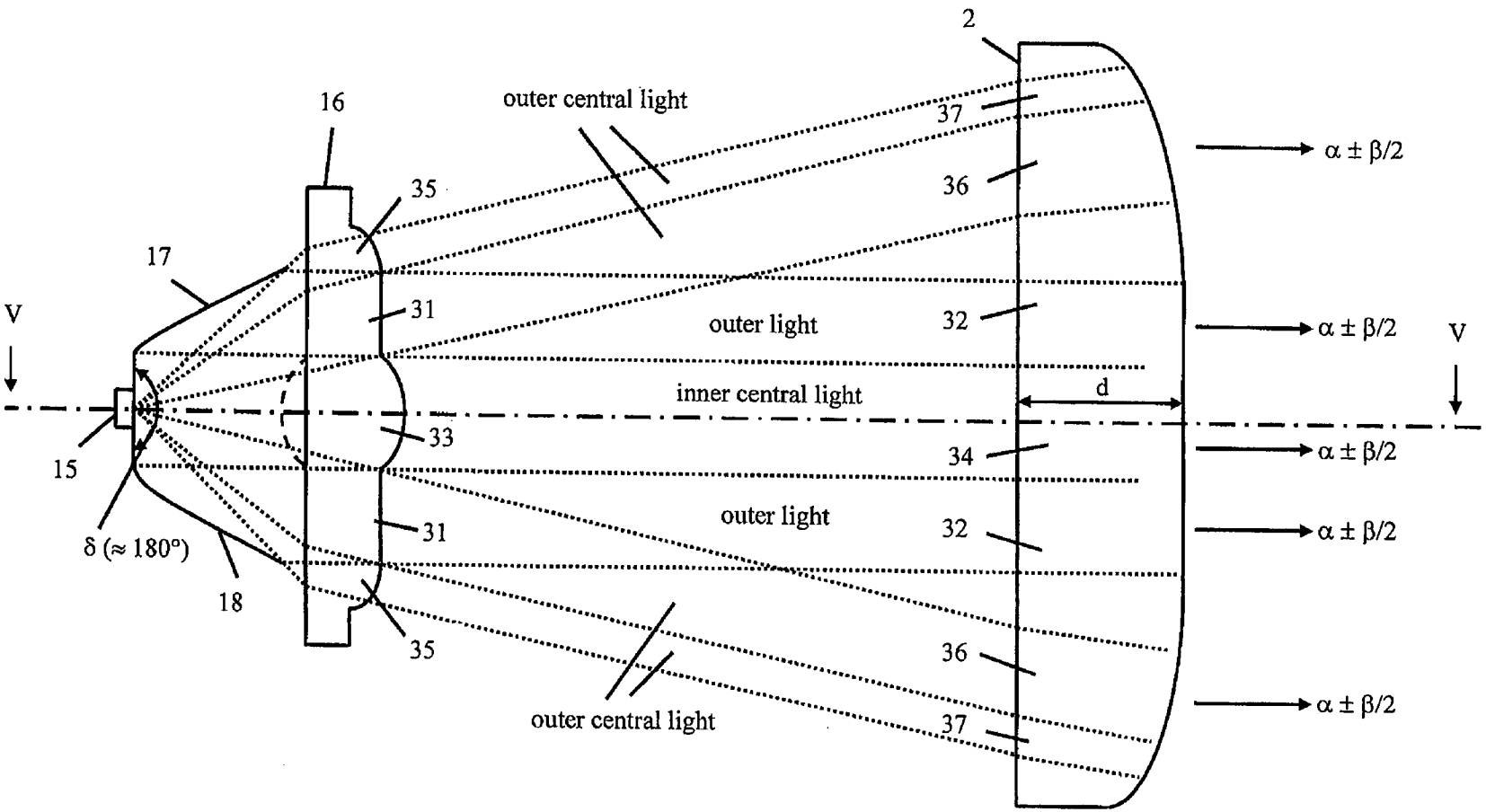
FIG. 4 the principle of influencing the radiation characteristic of the lighting means, FIG. 4A the principle of FIG. 4, showing only the outer light emitted outside the central polar range, FIG. 4B the principle of FIG. 4, showing only the inner central light emitted in the polar middle region of central polar range, FIG. 4C the principle of FIG. 4, showing only the outer central light emitted in the polar outside regions of the central polar range, FIG. 5 an illustration supplementing FIG. 4, FIG. 6 an outer drum optical system in an alternative embodiment, FIG. 7 a modification of FIG. 4, FIG. 8 a modification of FIG. 3, FIG. 9 a plan view of a sector of a lower part, FIG. 10 a sector of a support element in plan view, FIG. 11 a section through FIG. 10 along the line XI-XI in FIG. 10, FIG. 12 a diagram showing the principle, FIG. 13 a part of a further lamp in section, FIG. 14 the principle of FIG. 4, showing a non-reflecting bottom part, FIG. 15 the lamp in a partially cutaway perspective view, and FIG. 16 a perspective view of parts of the lamp, showing the polar plane, the normal plane, the azimuth angle and the polar angle.
Figure 4A:
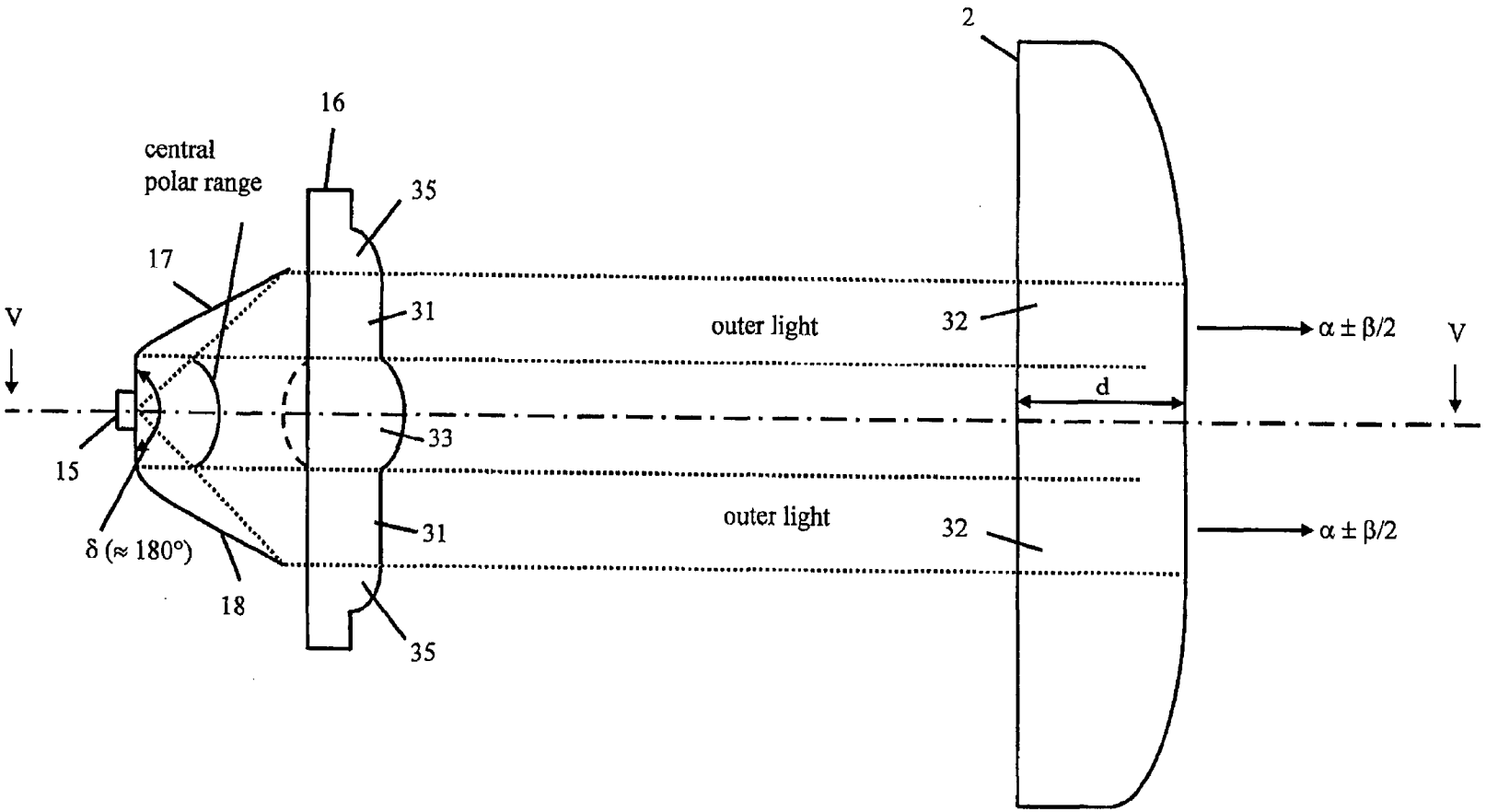
Figure 4B:
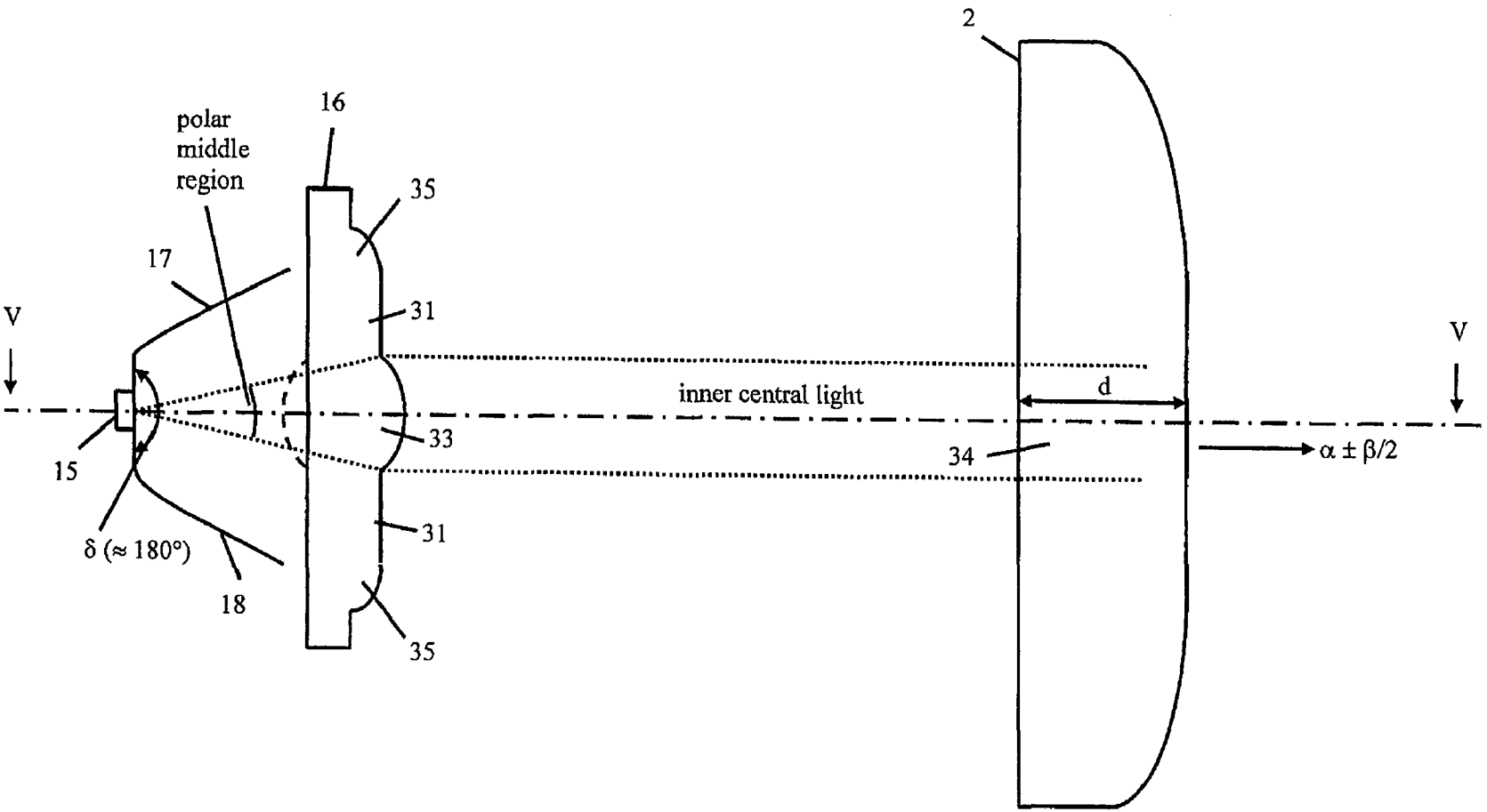
Figure 4C:
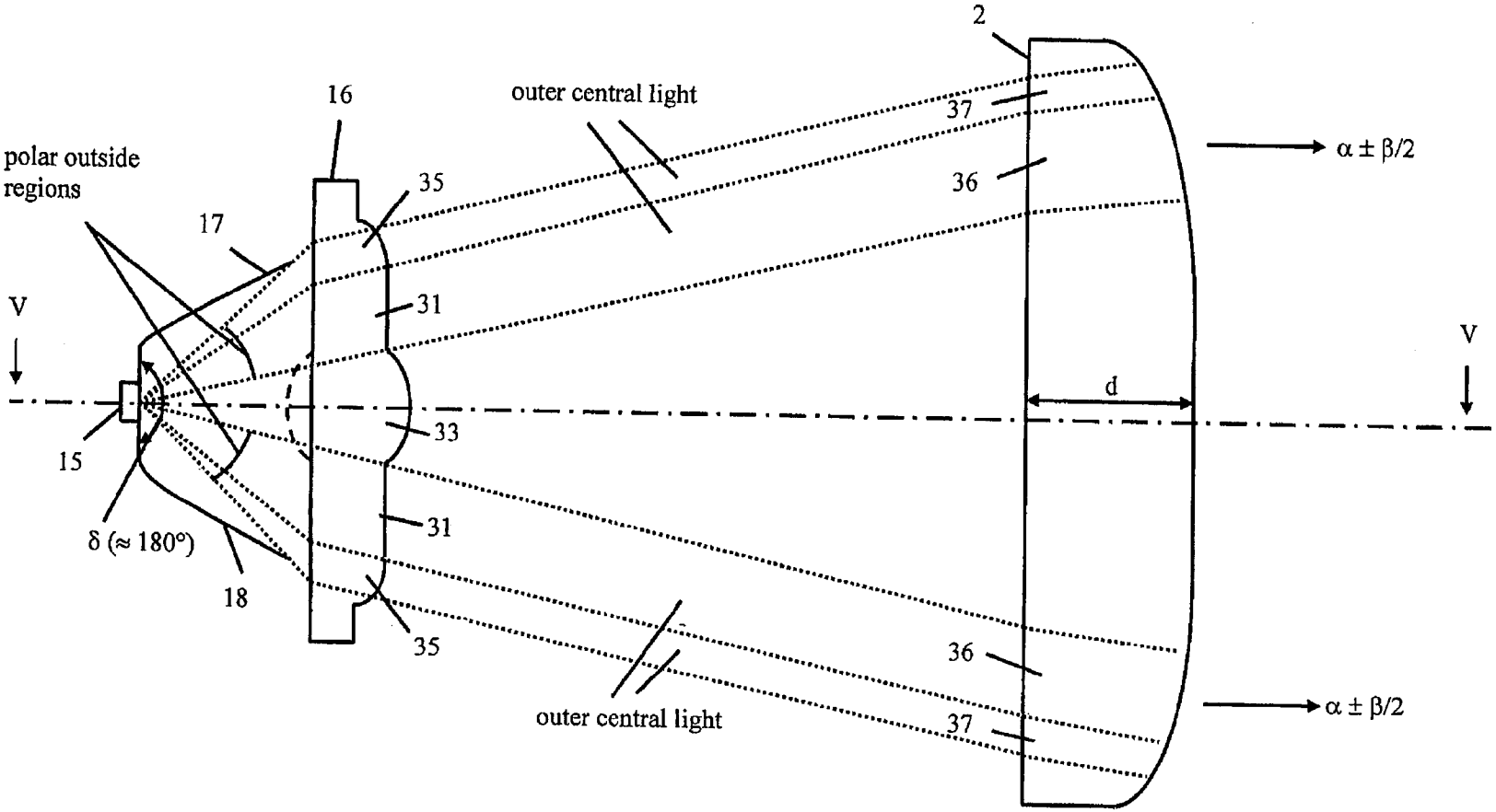

The optical principle of function of the lamp according to the invention is now explained in more detail in the following in conjunction with FIGS. 4 and 5, particularly in conjunction with FIG. 4. FIG. 4 is in that case a simplified illustration of FIG. 3, expanded by the outer drum optical system 2, and FIG. 5 a sectional illustration along the line V-V in FIG. 4.

Figure 5:
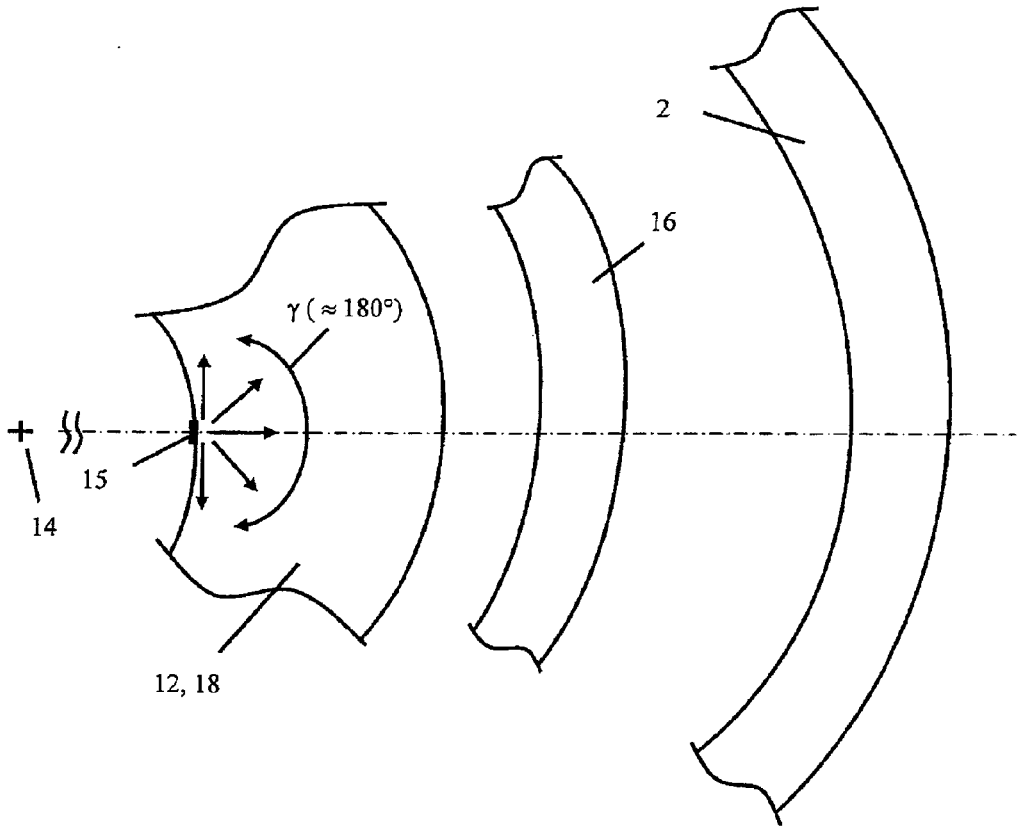

According to FIGS. 4 and 5 each of the lighting means 15 radiates its light radially outwardly with respect to the lamp axis 14 in a three-dimensional angular range. The three-dimensional angular range covers, about the lamp axis 14, an azimuth angle $\gamma$ amounting to approximately 180 degrees, thus considerably less than 360 degrees. Relative to the lamp axis 14, thus in polar direction, the three-dimensional angular range covers—see FIG. 2—a polar angle $\delta$ which as a rule is equal to the azimuth angle $\gamma$, thus similarly approximately 180 degrees. In each case this polar angle $\delta$ is substantially larger than the desired polar angle range $\beta$ in which the warning signal is to be radiated about the mean polar direction $\alpha$.

Light radiated by the lighting means 15 relative to the lamp axis 14 in a central polar angular range containing the mean polar direction $\alpha$, which is termed central light in the following, passes through the inner drum optical system 16 and the outer drum optical system 2 without previously impinging on the drum reflector 17, 18. Light radiated by the lighting means 15 outside this central polar range, termed outside light in the following, is, thereagainst, initially reflected by the drum reflector 17, 18 radially outwardly and only then passes through the inner drum optical system 16 and the outer drum optical system 2. For avoidance of confusion it may be clarified that regions accompanied by the adjective "polar" refer to angular regions in polar direction in which the light is initially radiated by the lighting means 15.

According to the invention the arrangement of the lighting means 15 and the drum reflector 17, 18 on the support element 10, the arrangement of the support element 10 and the drum optical systems 2 and 16 and the construction of the drum reflector 17, 18 and of the drum optical systems 2 and 16 are now matched to one another in such a manner that not only the central light, but also the outside light after issue from the outer drum optical system 2 are radiated in polar direction within the desired polar angular range $\beta$ about the mean polar direction $\alpha$. This is explained in more detail in conjunction with FIG. 4.

As already mentioned and as evident from FIG. 4 the reflective regions 17 and 18 are curved parabolically and the lighting means 15 are arranged in the focus line of the thus—defined drum parabola. The arrangement of the lighting means 15 and the drum reflector 17, 18 on the support element 10 and the construction of the drum reflector 17, 18 are thus matched to one another in such a manner that the outside light leaves the drum reflector 17, 18 as a light beam parallel in polar direction and is thus incident on the inner drum optical system 16. In a given case the light beam can also slightly diverge in polar direction. However, an exactly parallel orientation is preferred. The outside light incident on the inner drum optical system 16 is therefore initially—at least substantially—oriented in the mean polar direction $\alpha$.

The outside light passes, in an inner middle region 31, through the inner drum optical system 16 and thus penetrates it. In this inner middle region 31 the inner drum optical system 16 is preferably constructed in such a manner that the polar direction of the outside light is substantially unchanged by it. The system is thus preferably constructed in the inner middle region 31 as a cylindrical ring. However, in a given case it could also slightly refract the outside light towards the mean polar direction $\alpha$. In this case it could also happen that the outside light issues from the inner drum optical system 16 as a light beam slightly converging in polar direction. However, the outside light preferably issues from the inner drum optical system 16 as a light beam parallel in polar direction.

For avoidance of confusion it may be clarified that regions accompanied by the adjective "inner" or "outer" refer to regions of the (radially inwardly arranged) inner drum optical system 16 and the (radially outwardly arranged) outer drum optical system 2, respectively. The prefixes "inside", "middle" and "outside" in these regions refer to the position in polar direction with respect to the mean polar direction $\alpha$.

The external light penetrates the outer drum optical system 2 in an outer middle region 32. The arrangement and design of the individual optical elements 15, 17, 18, 16 and 2 are in that case according to FIG. 4 such that the outer middle region 32 is penetrated only by the outside light, but not also by the central light. It is therefore possible to design the outer middle region 32 of the outer drum optical system 2 in such a manner that the outside light issuing from the outer drum optical system 2 diverges slightly in polar direction. The outer drum optical system 2 can in that case be constructed in the outer middle region 32 in the alternative as a weak polar-acting lens or, however, as illustrated in FIG. 4, as a ring of uniform thickness d. In both cases, however, the outside light issuing from the outer middle region 32 of the outer drum optical system 2 in polar direction covers at most the desired polar angular range $\beta$ about the mean polar direction $\alpha$. The divergence of the outside light results, in the case of construction as a ring of uniform thickness d, as a consequence of the fact that the light-emitting diodes 15 have a finite area from which they radiate their light, thus are not punctiform light sources.

The central light contains light which is radiated in a polar middle region containing the mean polar direction $\alpha$. This light is termed inner central light in the following. It is characterised by the fact that at least up to entry into the inner drum optical system 16, preferably even up to exit from the inner drum optical system 16, it does not intersect the outside light. The central light, however, also contains light which intersects the outside light at the latest on issue from the inner drum optical system 16, possibly even within the inner drum optical system 16 or before the inner drum optical system 16. This light is radiated in two polar outer regions which, in polar direction, each adjoin the polar middle region at a respective side.

According to FIG. 4 the inner drum optical system 16 is constructed, in an inner inside region 33 in which it is penetrated exclusively by inner central light, as a polar-acting convergent lens, so that the inner central light is refracted by it towards the mean polar direction $\alpha$. It is thereby achieved that the inner central light does not intersect the outside light even in the region of the outer drum optical system 2.

The outer drum optical system 2 can therefore be similarly constructed in an outer inside region 34, in which it is penetrated exclusively by the inner central light, as a ring of uniform thickness d or as a weak polar-acting lens so that the inner central light issuing from the outer drum optical system 2 also diverges in polar direction. The divergence is in that case about the mean polar direction α and, in particular, at most about the desired polar angular range β. The construction, which is illustrated in FIG. 4, as a ring of uniform thickness d is then to be preferred.

The inner central light preferably issues from the inner drum optical system 16 as a light beam parallel in polar direction. Since, as already explained, the outside light moreover preferably also issues from the inner drum optical system 16 as a light beam parallel in optical direction it is possible to shape the outer drum optical system 2 in unitary manner in its outer middle regions 32 and its outer inside region 34 as is illustrated in FIG. 4.

The outer central light is not quite so simple to handle, because a part of the outer central light penetrates the inner drum optical system 16 in, in particular, an inner outside region 35 in which the inner drum optical system 16 is penetrated exclusively by the outer central light. It is possible to construct the inner drum optical system 16 in this region in such a manner that this part of the outer central light is individually influenced, in particular is refracted towards the mean polar direction α.

However, there is a further part of the outer central light which passes in the inner middle region 31 through the inner drum optical system 16. The outside light also passes through the inner drum optical system 16 in this region 31. However, the outer drum optical system 2 is radially spaced from the inner drum optical system 16 to such an extent that this part of the outer central light is incident on the outer drum optical system 2 in a first outer outside region 36 and penetrates this, wherein the first outer outside region 36 no longer intersects the outer middle region 32 and not even the outer inside region 34. The first outer outside region 36 of the outer drum optical system 2 is therefore exclusively penetrated by the part of the outer central light which has penetrated the inner drum optical system 16 in the region of the inner middle region 31. It is therefore also possible to form the first outer outside region 36 in such a manner that this part of the outer central light is refracted in polar direction towards the mean polar direction α. It is thus possible to construct the outer drum optical system 2 in such a manner that this part of the outer central light issuing from the outer drum optical system 2 diverges in polar direction about the mean polar direction α, but at most covers the desired polar angular region β.

The part of the outer central light which has penetrated the inner outside region 35 is deflected by the inner drum optical system 16 preferably in polar direction in such a manner that it issues from the inner drum optical system 16 as a light beam substantially parallel or slightly diverging in polar direction. The deflection is then so selected that this part of the outer central light passes through the outer drum optical system 2 in a second outer outside region 37 different from the first outer outside region 36. It is therefore possible also with respect to this second outer outside region 37 to construct the outer drum optical system 2 in such a manner that this part of the outer central light is refracted by the outer drum optical system 2 in polar direction towards the mean polar direction α and after issue from the outer drum optical system 2 diverges in polar direction about the mean polar direction α, but in that case at most covers the desired polar angular range β.

In the basic form of construction of the present invention described in the foregoing in conjunction with FIGS. 1 to 5 the outer drum optical system 2 has to have a relatively large radial thickness d (see FIG. 4). This is required so as to be able to also deflect the outer central light completely in the desired polar angular range β about the mean polar direction α.

Figure 6:
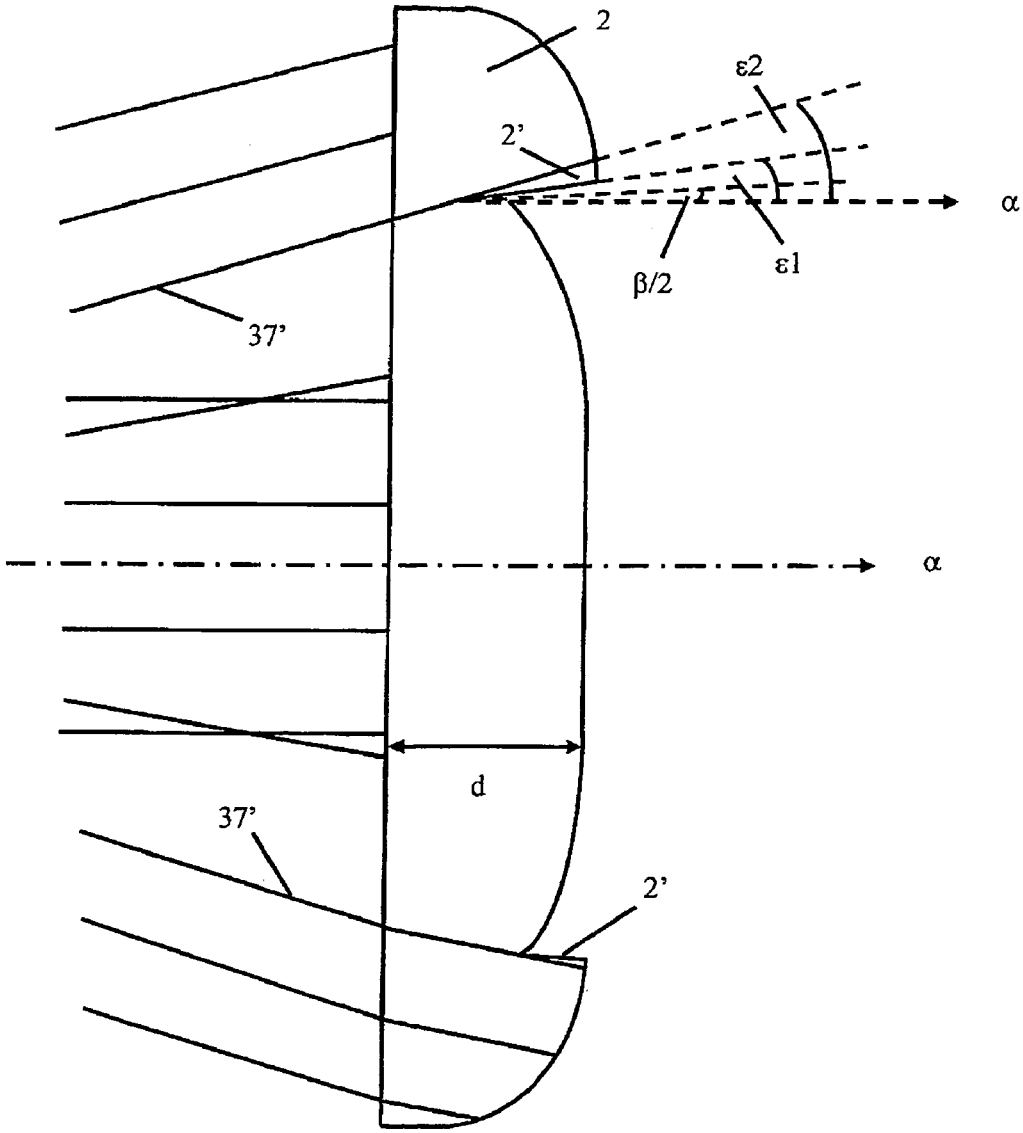

In the form of embodiment according to FIG. 6 this radial thickness d can be reduced by constructing the outer drum optical system 2 as a Fresnel optical system 2 at least in its outer outside regions 36 and 37. The construction as a Fresnel optical system 2 in that case is preferably carried out, according to FIG. 6, radially outwardly with respect to the lamp axis 14. The outer drum optical system 2 thus has at least one step 2' radially outwardly in its outer outside regions 36 and 37. This step 2' is not penetrated by light which is radiated or to be radiated.

The step 2' forms an inclination angle ϵ1 with the mean polar direction α. The inclination angle ϵ1 is in that case at least half the size of the desired polar angular range β because then there is no screening of light which has already penetrated the outer drum optical system 2 and has issued therefrom.

A light beam 37', which is radially inwardly tangential to the step 2', forms a radiation angle ϵ2 with the mean polar direction α. The inclination angle ϵ1 is preferably at most as large as the radiation angle ϵ2 because then there is no screening of light which penetrates the outer drum optical system 2 in the region of the step 2'.

Figure 7:
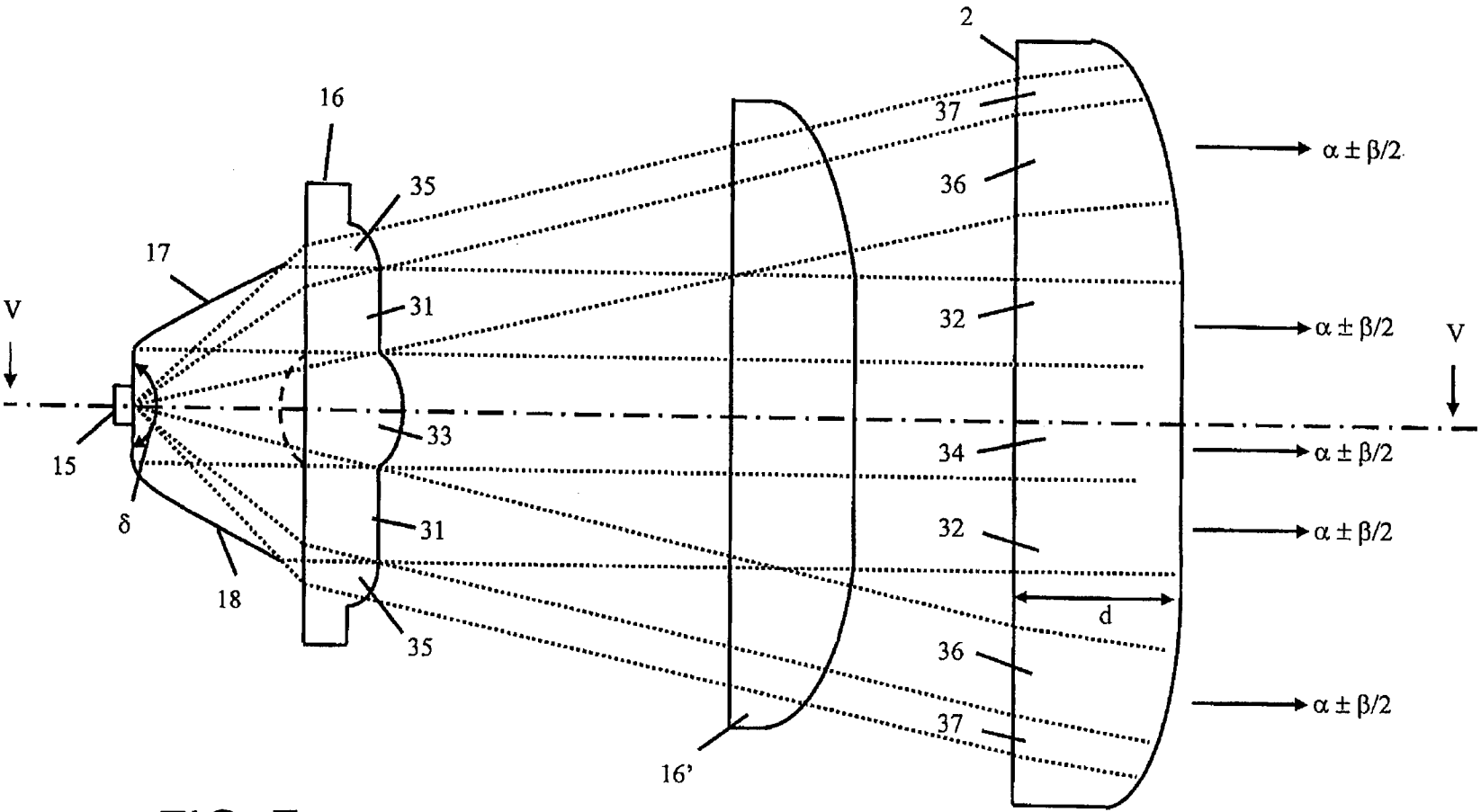

Alternatively or additionally to the construction of the outer drum optical system 2 as a Fresnel optical system 2 it is also possible according to FIG. 7 to arrange between the inner drum optical system 16 and the outer drum optical system 2 one or more further drum optical systems 16' which is or are similarly a component of the optical basic arrangement. According to FIG. 7 by way of example a single further drum optical system 16' is arranged between the inner drum optical system 16 and the outer drum optical system 2. The further drum optical system 16' can in that case be mounted by the support element 10. The further drum optical system 16' is, however, preferably also mounted between the cover 3 and the support flange 6 like the outer drum optical system 2. For preference it is mounted, just like the inner drum optical system 16 and the outer drum optical system 2, in floating manner, in particular by way of a respective O-ring or by way of two respective O-rings, towards the cover 3 and support flange 6.

The further drum optical system 16' is preferably constructed, in the region in which it is penetrated by the inner central light and by the outside light, as a ring with constant radial thickness because the polar direction of the inner central light and of the outside light is thereby substantially unchanged by it. Outside this region, thus—presupposing corresponding mounting of the further drum optical system 16'—towards the cover 3 and the support flange 6, the further drum optical system 16' is penetrated exclusively by outer central light. In this region it is constructed as a convergent optical system 16' acting in polar direction. Thus, in this region it refracts the outer central light towards the mean polar direction α.

As already mentioned, the embodiment according to FIG. 7 is possible alternatively or additionally to the embodiment according to FIG. 6. However, as a rule one of the measures of FIGS. 6 and 7 is sufficient to achieve deflection of the entire light, which is radiated by the light-emitting diodes 15, in the desired polar angular range β about the mean polar direction α.

Figure 8:
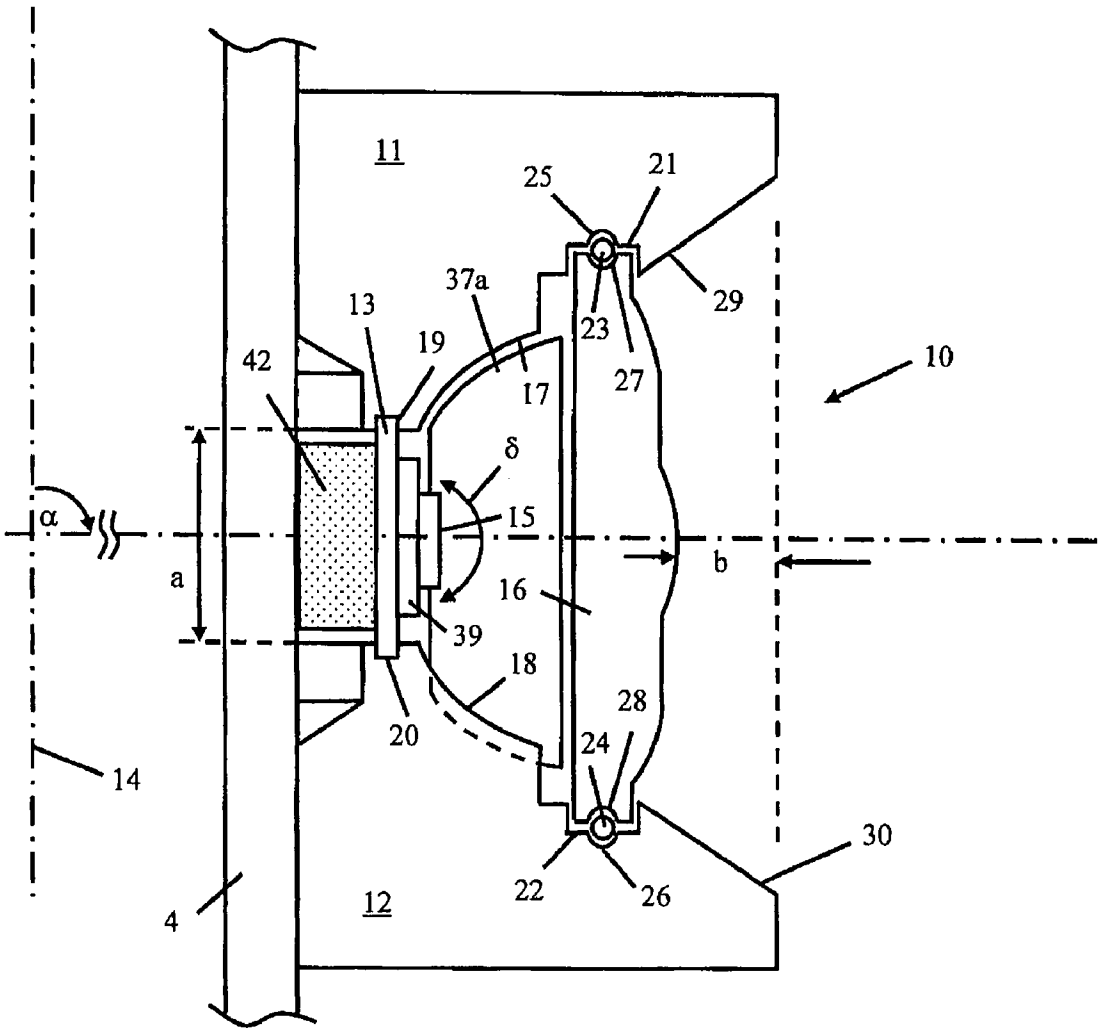

If, in an individual case, a particularly small desired polar angular range β about the mean polar direction α is required it may be the case that even the measures described in the foregoing are still not sufficient in order to achieve the required radiation characteristic. It can then be helpful to separate the light paths of the individual lighting means 15 in tangential direction from one another. For this purpose according to FIG. 8 a respective separating web 37*a* is preferably arranged on the support element 10 between each two lighting means 15. The separating webs 37*a* extend in radial direction from the lighting means 15 to the inner drum optical system 16. According to FIG. 8 they are constructed to be light-absorbing.

Figure 9:
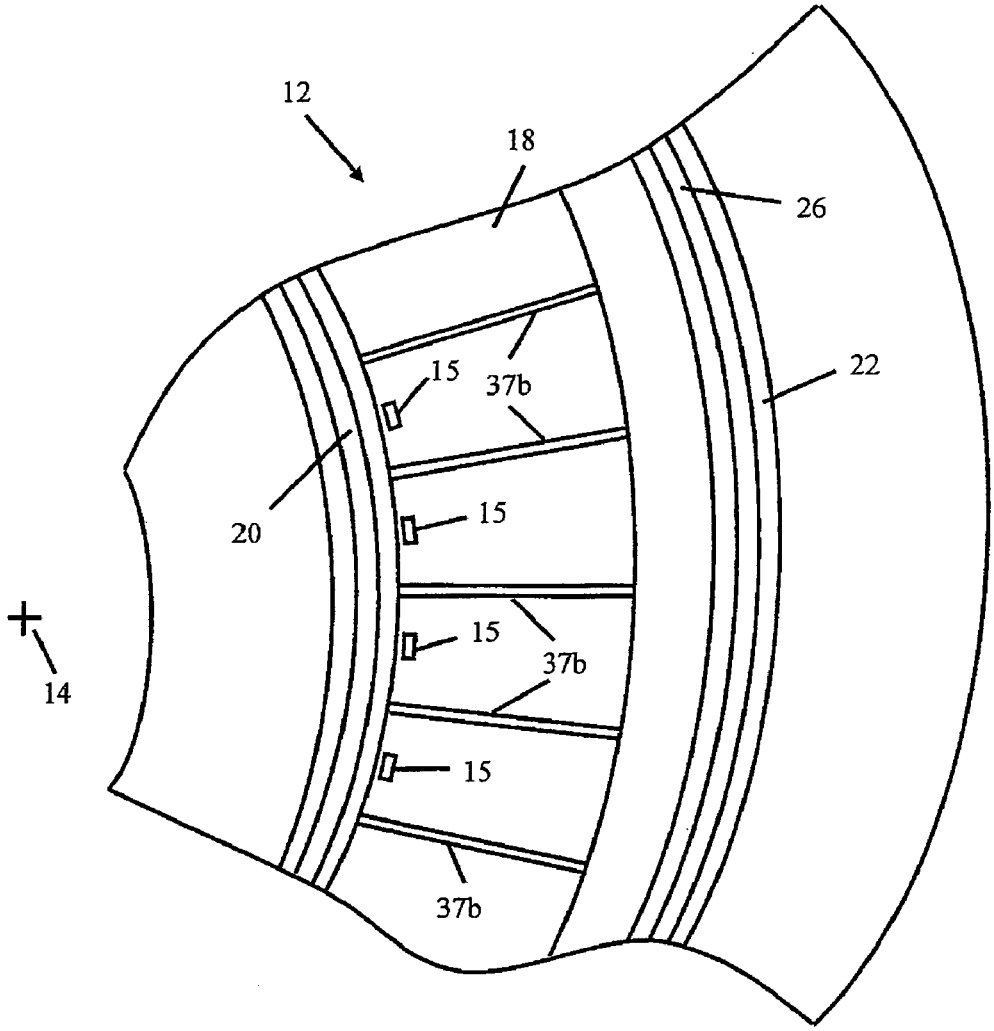

The separating webs 37*a* are usually arranged either all in the upper part 11 or all in the lower part 12. According to FIG. 8 they are, by way of example, arranged in the lower part 12. The lower part 12 therefore has, according to FIG. 9, separating web receiving grooves 37*b* in which the separating webs 37*a* are received. The separating webs 37*a* are preferably mounted in the lower part 12 by a clamping seat. Alternatively or additionally they can also be glued in the lower part 12. According to FIG. 8 the separating webs 37*a* are slightly spaced in axial direction from the upper part 11.

Figure 10:
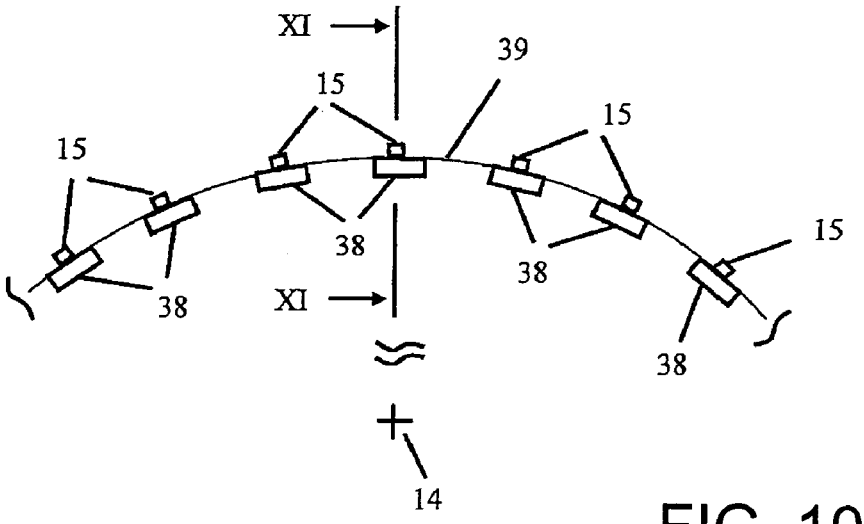

According to FIG. 10, which shows a further detail of the middle part 13 of the support element 10, the middle part 13 consists of a plurality of individual elements 38 which are arranged circularly around the lamp axis 14 so that each of the individual elements 38 covers a tangential sector about the lamp axis 14. In that case exactly one of the lighting means 15 is arranged on each of the individual elements 38. The individual elements 38 are connected together by a circuitboard 39, which is preferably flexible.

The individual elements 38 preferably consist of metal, especially aluminium. They typically have, in radial direction, a thickness of 1.5 to 3 millimeters, for example 2 millimeters. In circumferential direction they typically have a width of 8 to 15 millimeters, for example 10 millimeters. In the direction of the lamp axis 14 they typically have a height between 40 and 50 millimeters, for example 45 millimeters.

The lighting means 15 are constructed in the present case as high-output light-emitting diodes 15. The loss heat created therein therefore has to be dissipated. For this purpose the lighting means 15 have, according to FIG. 11, a respective thermal contact surface 40 in radially inward direction. The thermal contact surfaces 14 are preferably metallically coated for enhanced heat dissipation. The lighting means 15 are thermally coupled with the individual elements 38 by way of the thermal contact surfaces 40. The coupling is in that case effected by way of an electrically insulating thermally conductive adhesive 41.

The lighting means 15 obviously have to be electrically connected. This is carried out by way of the already mentioned—preferably flexible—circuitboard 19. According to FIG. 11 the circuitboard 19 is arranged between the individual elements 38 and the lighting means 15. In order, however, to have the least possible impairment of the heat dissipation from the lighting means 15 to the individual elements 38 the circuitboard 39 has recesses in the region of the thermal contact surfaces 40 so that the lighting means 15 are directly glued with the individual elements 38 by way of the thermally conductive adhesive 41.

If the lower part 11 and the upper part 12 of the support element 10 similarly consist of metal (particularly of steel) a further discharge of the loss heat preferably takes place by way of the upper part 11 and the lower part 12. Alternatively or additionally it is also possible, however, for the individual elements 38—see FIGS. 3 and 11—to be thermally coupled with the base body 1 or the central tube 4 of the base body 1 by way of a thermally conductive film 42. The thermally conductive film 42 can then be constructed as, in particular, a foam film 42 so that it is compressible. A foam film 42 thus has the effect, inter alia, that the support element 10 is radially spaced from the central tube 4. Since the thermally conductive film 42 additionally acts in electrically insulating manner, there is no electrical contact between the support element 10 and the base body of the lamp as seen in radial direction.

As already mentioned, the lighting means 15 are arranged uniformly annularly around the lamp axis 14. The angles, which are indicated in FIG. 12, of (by way of example) 9 degrees and 72 degrees are therefore tangential angles about the lamp axis 14.

Figure 12:
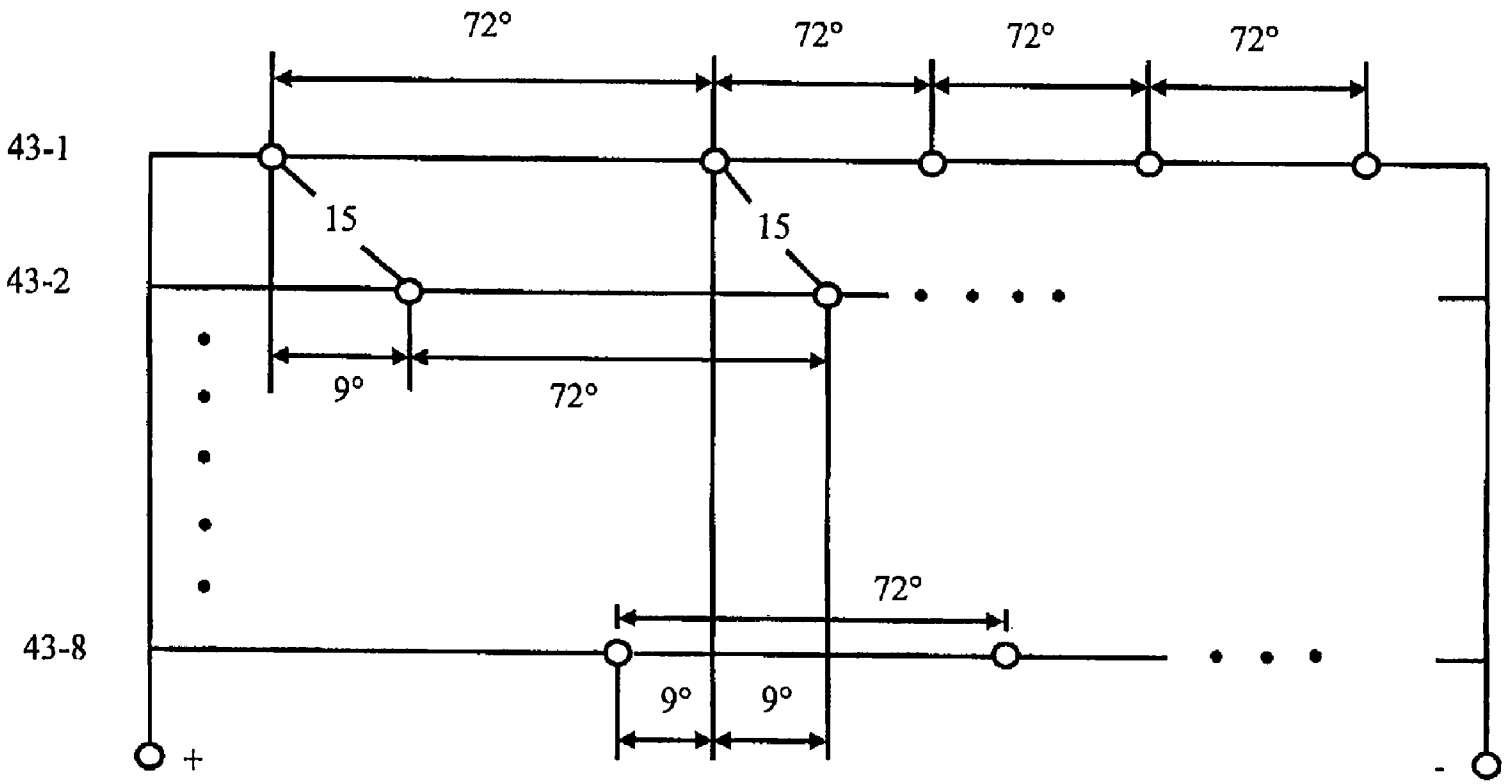

In the electrical respect each of the lighting means 15 is, according to FIG. 12, arranged in one of several branches 43-1 to 43-8. According to FIG. 12 the branches 43 are electrically connected in parallel with one another. Within each branch 43 the lighting means 15 arranged in the respective branch are, however, electrically connected in series with one another.

As apparent from FIG. 12, the lighting means 15 of the each of the branches 43 are, in themselves, similarly uniformly arranged around the lamp axis 14. If for whatever reasons one of the branches 43 fails, a dead region in which no light is radiated therefore does not result in tangential direction about the lamp axis 14. Rather, a so-termed graceful degradation results.

According to FIG. 12 eight branches 43-1 to 43-8 are present, wherein five light-emitting diodes 15 are arranged in each branch. In total, forty light-emitting diodes 15 are thus present. However, other numbers are also possible. Minimum values of six branches 43, four light-emitting diodes 15 per branch 43 and in total thirty light-emitting diodes 15 should, however, be minima. Moreover, the number of light-emitting diodes 15 per branch 43 shall be the same for all branches 43.

Figure 13:
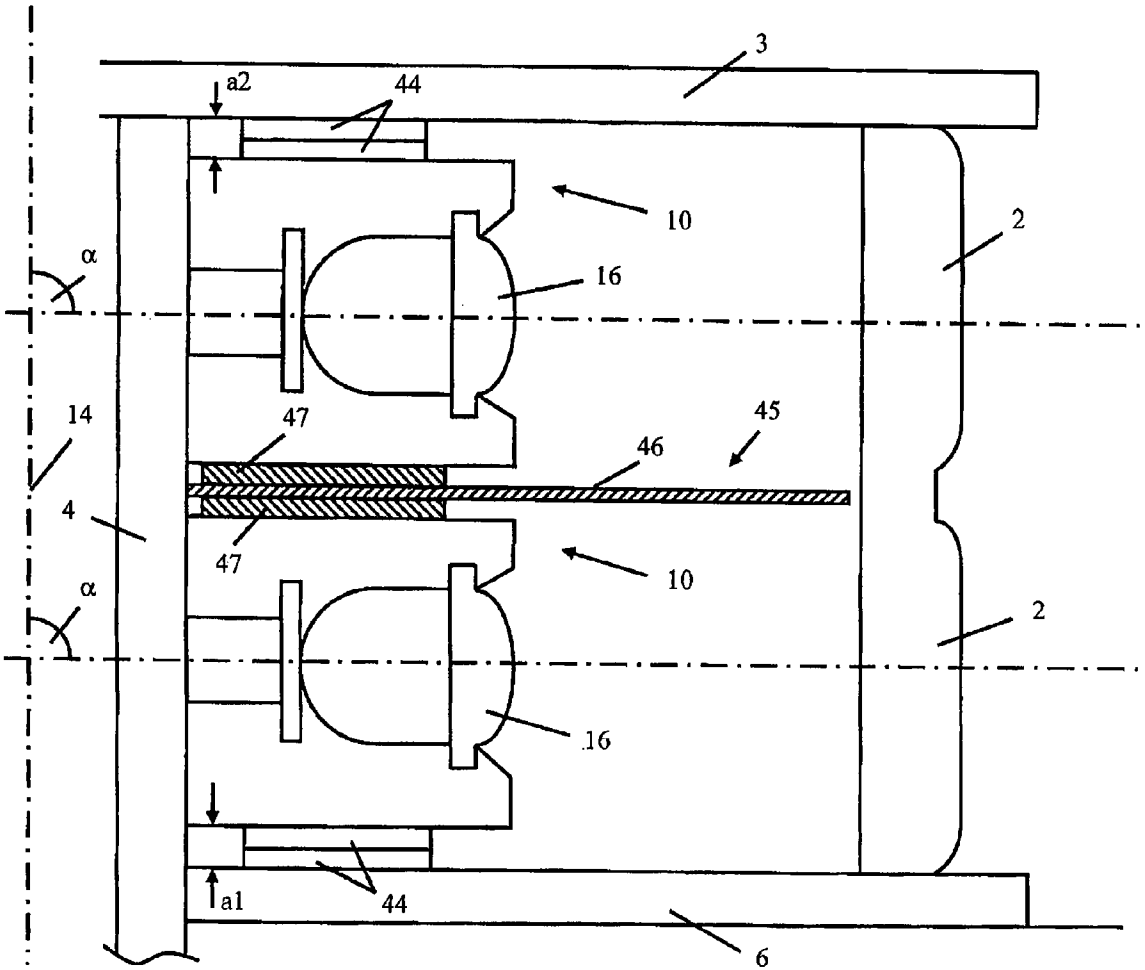
Figure 14:
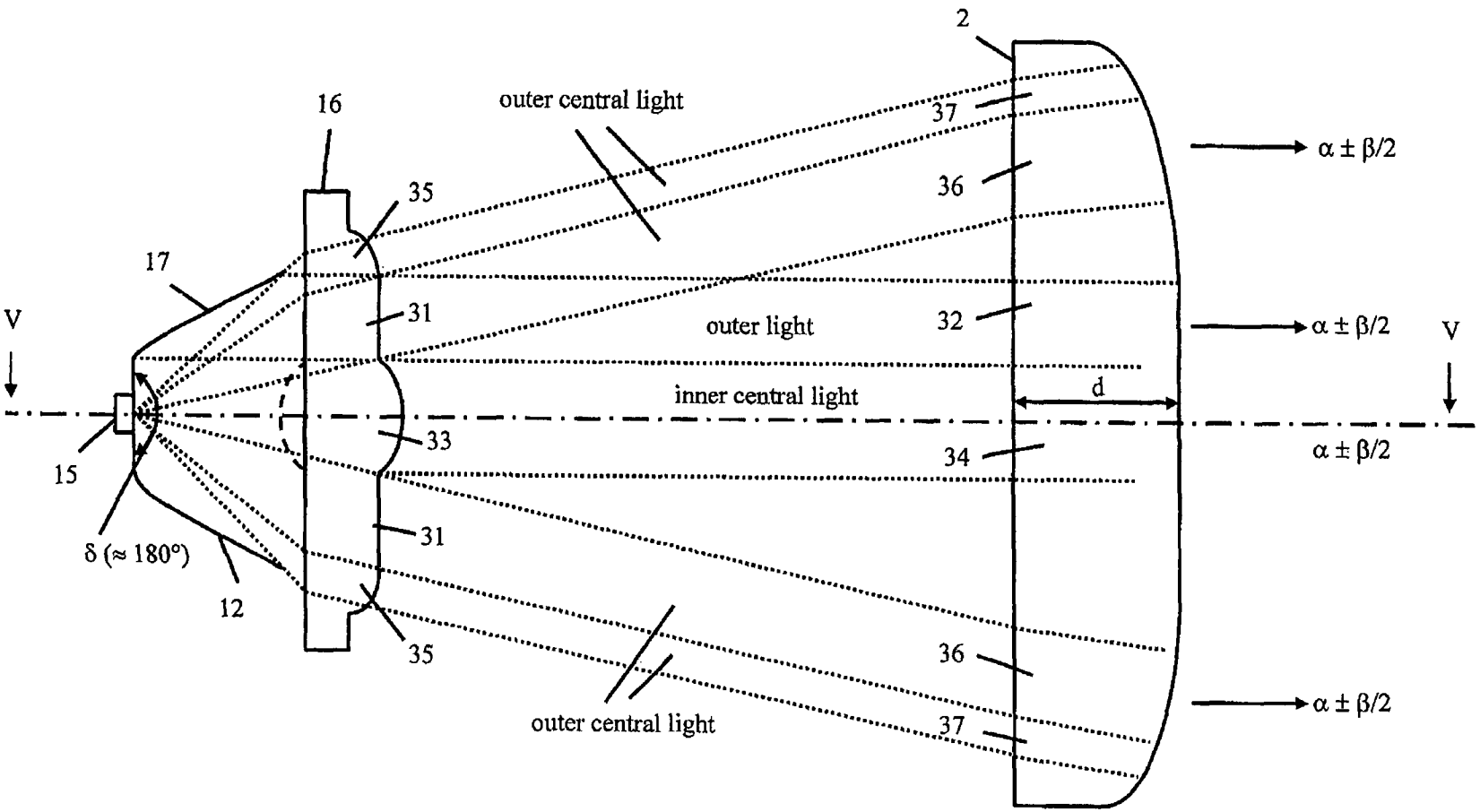
Figure 15:
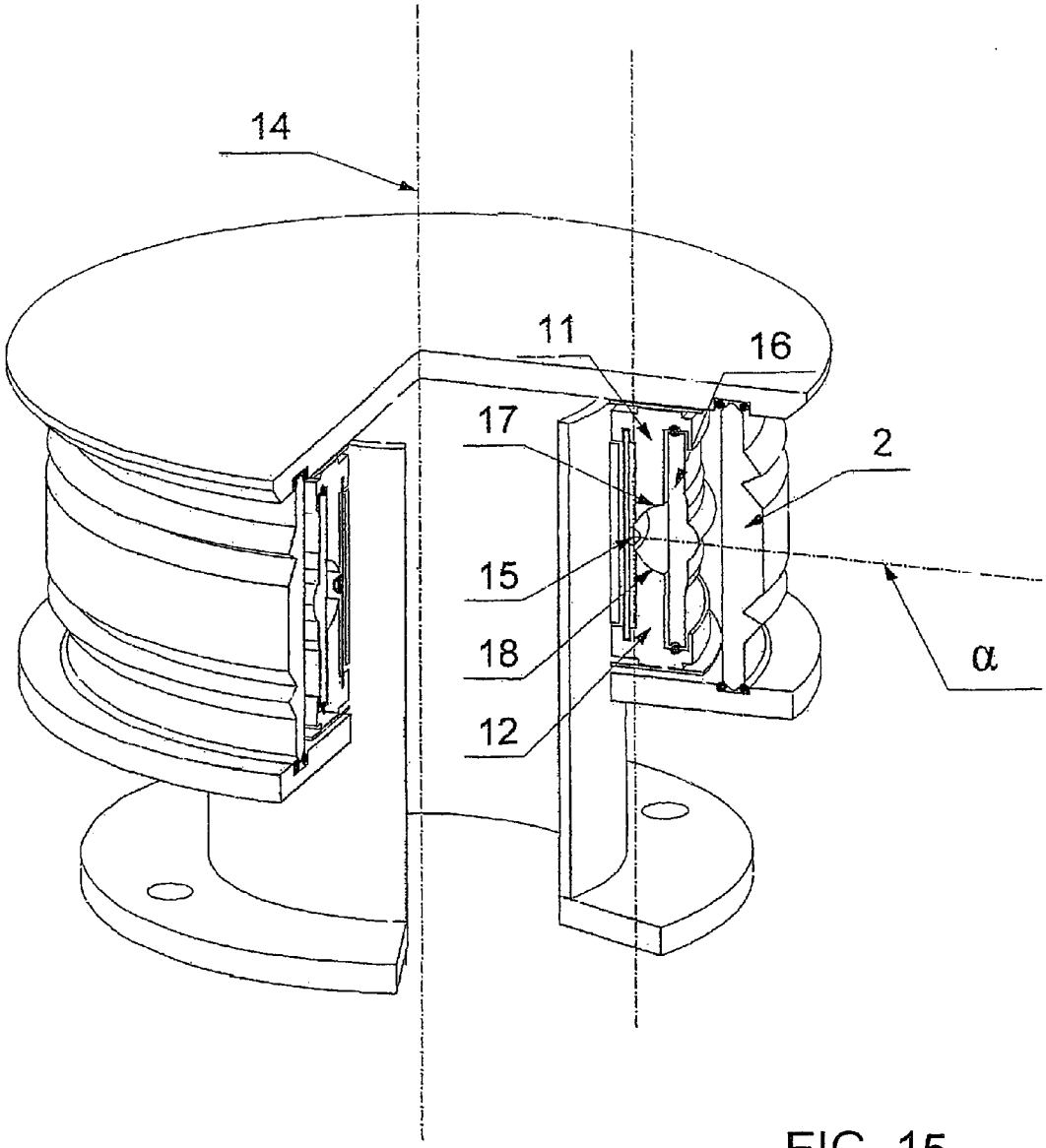
Figure 16:
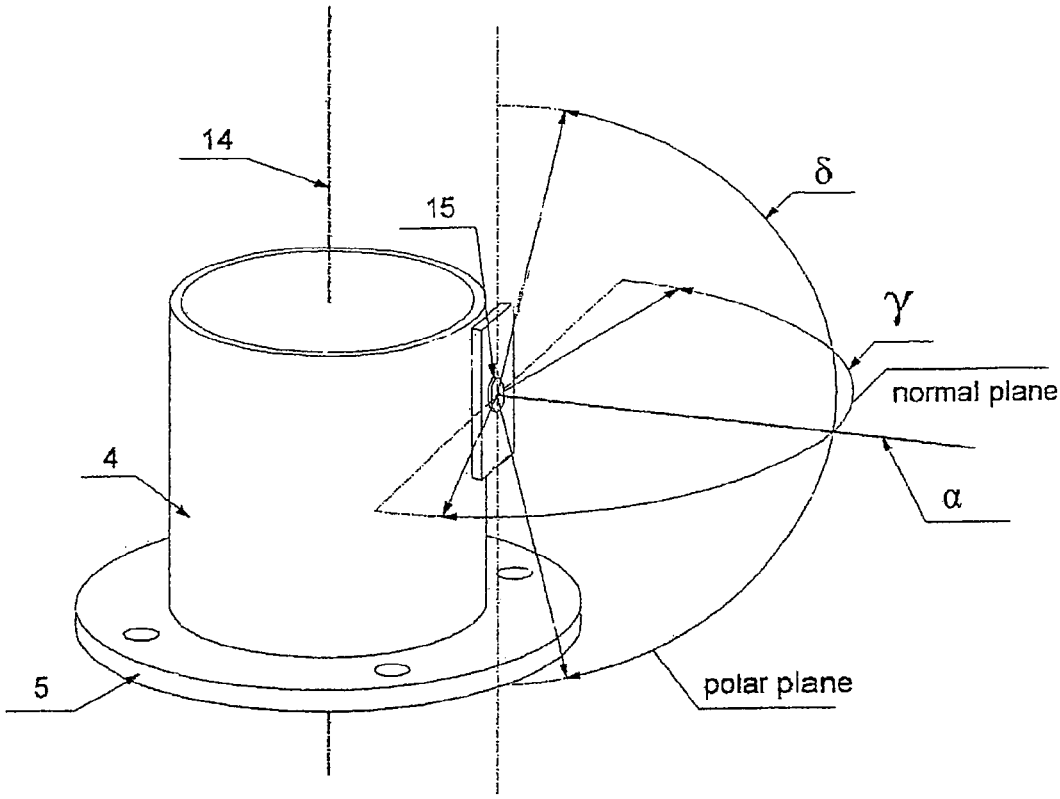

If the light intensity of the lamp described in the foregoing in connection with FIGS. 1 to 12 is not sufficiently high the lamp of FIGS. 1 to 12 can be modified in correspondence with FIG. 13, since the lamp of FIG. 13 has an optical auxiliary arrangement in addition to the optical basic arrangement. The optical arrangements are in that case, as apparent, arranged one above the other as seen in the direction of the lamp axis 14. Each of the optical arrangements is constructed as explained in the foregoing in conjunction with FIGS. 1 to 12, particularly FIGS. 3 and 4.

The optical arrangement arranged at the bottom in FIG. 13 is regarded in the following as the optical basic arrangement. Conversely, the optical arrangement arranged at the top in FIG. 13 is regarded as optical auxiliary arrangement. The optical basic arrangement is mounted at a defined spacing a1 from the support flange 6 as seen in the direction of the lamp axis 14. Equally, the optical auxiliary arrangement is mounted at a defined spacing a2 from the cover 3 as seen in the direction of the lamp axis 14. The defined spacings a1 and a2 are in that case the same as one another. This is not, however, absolutely necessary. Adjustment of the defined spacings a1 and a2 is preferably carried out by way of adjusting rings 44.

The adjusting rings 44 preferably have a defined thickness and consist of a virtually non-deformable material. For example, the adjusting rings 44 consist of metal, for example again aluminium. However, they can also consist of an electrically insulating material, in particular be equally constructed as thermally conductive film. In this case the thermal coupling of the support element 10 and thus also the lighting means with the support flange 6 and the cover 3 is maintained.

However, in this case there is also no electrical contact between the support element 10 and the base body 1 of the lantern as seen in axial direction. The support element 10 is therefore completely-electrically insulated from the base body 1 of the lamp.

As already mentioned, the lighting means 15 are preferably high-output light-emitting diodes. The loss heat arising in the lighting means 15 thus has to be dissipated. For optimisation of the heat dissipation it can therefore be useful to arrange cooling bodies 44' at the support flange 6 and/or the cover 3 in accordance with FIG. 1. By virtue of these cooling bodies 44' a greater amount of heat can then be delivered to the environment than without it. The cooling bodes 44' are not illustrated in FIG. 2 only for the sake of retaining the clarity of FIG. 2.

Figure 11:
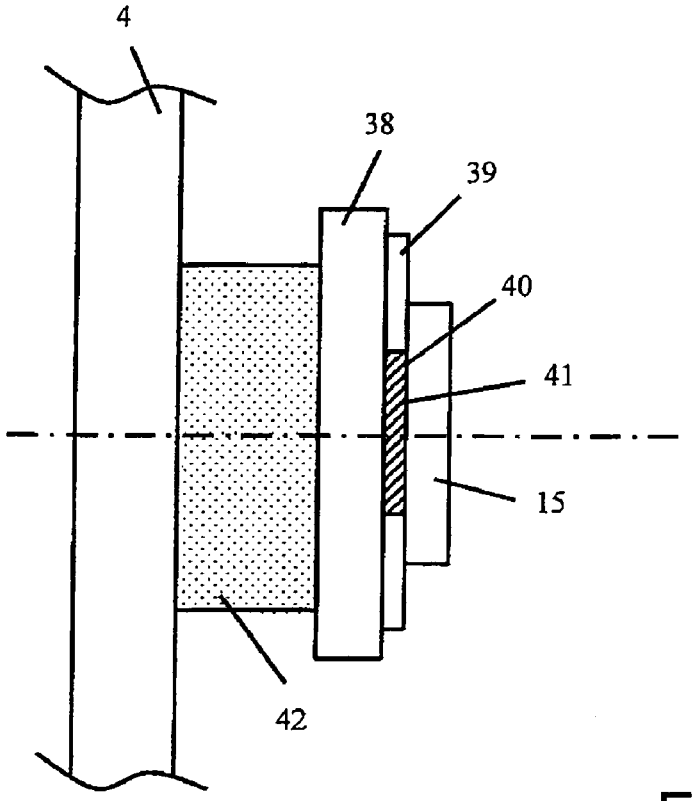

According to FIG. 11 the outer drum optical systems 2 of the optical arrangements are integrally connected together. Moreover, they are mounted between the support flange 6 and the cover 3 analogously to the embodiment with only the optical basic arrangement. If—cf. the above explanations with respect to possible further drum optical systems 16'—these further drum optical systems 16' are also mounted between the cover 3 and the support flange 6 these drum optical systems 16' are also preferably integrally connected together.

A resilient spacer 45 arranged between the support elements 10 of the optical arrangements is provided for pressing the support elements 10 of the optical arrangements against the support flange 6 and the cover 3, respectively. The spacer 45 consists of, for example, a thin metal shim 46 provided in the region towards the support elements 10 with resilient layers 47. The layers 47 can consist of, for example, rubber.

As apparent, the spacer 45 extends radially outwardly beyond the support elements 10. It preferably extends as far as shortly in front of the drum optical systems 2 arranged furthest radially inwardly, here the outer drum optical systems 2, which are integrally connected together and mounted between the support flange 6 and the cover 3.

By means of the lamp according to the invention there has thus been created a reliable, robust lamp which combines an extremely high light intensity with a comparatively simple construction and a high operational reliability in the sense of a graceful degradation. Depending on the respectively employed lighting means 15, light intensities up to 2,000 candela are thus achievable.

What is claimed is:

1. A method for constructing a lamp for radiating a warning signal within a desired polar angular range around a mean polar direction, the method comprising the steps of:

a) fixing a base body at a mounting location;

b) arranging an annular support element comprising an annular reflector concentrically around a lamp axis, wherein seen in the direction of the lamp axis, the annular support element comprises an upper part, a lower part and a center part, wherein the upper part and the lower part are held by the center part at a defined spacing from one another;

c) manufacturing the upper part and the lower part as annular elements on a lathe;

d) forming a region of at least one of the upper part and the lower part facing the respective other part to be reflective, wherein the region formed to be reflective forms the annular reflector;

e) arranging an inner annular optical system concentrically around the lamp axis, wherein the inner annular optical system has a first finite thickness in a direction radial to the lamp axis and comprises two first inner areas, a second inner area separate from and adjacent to the two first inner areas and two third inner areas, each of the two third inner areas overlapping a respective one of the two first inner areas;

f) arranging an outer annular optical system concentrically around the lamp axis, wherein the outer annular optical system has a second finite thickness in the direction radial to the lamp axis and comprises two first outer areas, a second outer area separate from the two first outer areas and two third outer areas separate from the two first outer areas and the second outer area, the annular support element, the inner annular optical system and the outer annular optical system forming an optical arrangement;

g) arranging a plurality of lighting elements on the center part of the annular support element in an annular distribution around the lamp axis, wherein each of the plurality of lighting elements defines a respective polar plane including the lamp axis and intersecting a respective lighting element of the plurality of lighting elements and wherein the respective lighting element radiates light in the respective polar plane such that a portion of the light radiated in the respective polar plane is radiated within a central polar range containing a mean polar direction and a remainder of the light radiated in the respective polar plane is radiated outside the central polar range, the central polar range comprising a polar middle region containing the mean polar direction and two polar outside regions adjoining the polar middle region at either side;

h) shaping the annular reflector in such a manner that the light radiated by the respective lighting element in the central polar range is not reflected by the annular reflector, but passes first through the inner annular optical system, and then through the outer annular optical system;

i) shaping the annular reflector to reflect the light radiated by the respective lighting element outside the central polar range radially outwardly, such that the light radiated by the respective lighting element outside the central polar range and reflected by the annular reflector passes through the two first inner areas;

j) shaping the two first inner areas to direct the light reflected by the reflector and passing through the two first inner areas to the two first outer areas;

k) shaping the two first outer areas such that the light passing through the two first inner areas and directed to the two first outer areas emerges from the two first outer areas in a direction within a desired polar angular range around the mean polar direction;

l) shaping the inner annular optical system in such a manner that the light radiated by the respective lighting element within the polar middle region passes through the second inner area;

m) shaping the second inner area to direct the light passing through the second inner area to the second outer area;

n) shaping the second outer area such that the light passing through the second inner area and directed to the second outer area emerges from the second outer area in a direction within the desired polar angular range around the mean polar direction;

o) shaping the inner annular optical system in such a manner that the light radiated by the respective lighting element in the two polar outside regions passes through the two third inner areas;

p) shaping the two third inner areas to direct the light passing through the two third inner areas to the two third outer areas; and q) shaping the two third outer areas such that the light passing through the two third inner areas and directed to the two third outer areas emerges from the two third outer areas in a direction within the desired polar angular range around the mean polar direction.

2. The method according to claim 1, further comprising the step of adapting an arrangement of the plurality of lighting elements and the annular reflector on the annular support element and a shape of the annular reflector to one another in such a manner that for each lighting element the light radiated in the respective polar plane outside the central polar range is incident on the inner annular optical system as one of a parallel light beam and a slightly diverging light beam within the respective polar plane.

3. The method according to claim 2, further comprising the step of shaping the inner annular optical system such that for each lighting element the light radiated in the respective polar plane outside the central polar range issues from the inner annular optical system as one of a parallel light beam and a slightly converging light beam within the respective polar plane.

4. The method according to claim 1, wherein the inner annular optical system further comprises an intermediate region, the intermediate region comprising a portion of each of the two third inner areas overlapping a respective one of the two first inner areas, wherein the intermediate region is penetrated by both the light emitted by the respective lighting element outside the central polar range and the light emitted by the respective lighting element within the polar outside regions, and further comprising the step of shaping the intermediate region in one of a manner that a direction of the light emitted by the respective lighting element and passing through the intermediate region is substantially unchanged and a manner that the light emitted by the respective lighting element and passing through the intermediate region is refracted slightly towards the mean polar direction.

5. The method according to claim 1, further comprising the steps of forming the second inner area as a convergent lens and shaping the convergent lens to refract the light emitted by the respective lighting element within the polar middle region towards the mean polar direction.

6. The method according to claim 1, wherein the second outer area of the outer annular optical system comprises a ring of uniform thickness.

7. The method according to claim 1, wherein for each lighting element as seen in the respective polar plane of the respective lighting element, the two third inner areas of the inner annular optical system comprise outer regions which are penetrated exclusively by the light emitted by the respective lighting element in the respective polar outside regions and further comprising the step of shaping the outer regions to refract the light emitted by the respective lighting element in the respective polar outside regions and passing through the outer regions towards the mean polar direction.

8. The method according to claim 7, wherein the light emitted by the respective lighting element in the respective polar outside regions emerges from the outer regions, as seen in the respective polar plane of the respective lighting element, as one of a substantially parallel light beam or a slightly diverging light beam.

9. The method according to claim 1, further comprising the step of shaping the two third outer areas of the outer annular optical system to refract the light emitted by the respective lighting element within the respective polar outside regions and passing through the two third outer areas towards the mean polar direction so that, as seen in the respective polar plane of the respective lighting element, the light emitted by the respective lighting element within the respective polar outside regions and emerging from the outer annular optical system diverges, but at most covers the desired polar angular range.

10. The method according to claim 1, further comprising the step of constructing the outer annular optical system at least in the two third outer areas as a Fresnel optical system.

11. The method according to claim 1, further comprising the step of constructing the outer annular optical system in the first outer areas as a ring of uniform thickness.

12. The method according to claim 1, further comprising the step of arranging the inner annular optical system between the upper part and the lower part.

13. The method according to claim 12, further comprising the step of mounting the inner annular optical system to be floating relative to both the upper part and the lower part.

14. The method according to claim 1, further comprising the step of constructing one of the upper part and the lower part to be reflective and the other one of the upper part and the lower part to be light-absorbing.

15. The method according to claim 1, wherein the mean polar direction forms an angle of 90 degrees with the lamp axis.

16. The method according to claim 1, wherein the desired polar angular range is two to ten degrees.

17. A method for constructing a lamp for radiating a warning signal within a desired polar angular range around a mean polar direction, the method comprising the steps of:

a) fixing a base body at a mounting location;

b) arranging an annular support element comprising an annular reflector concentrically around a lamp axis;

c) arranging an inner annular optical system concentrically around the lamp axis, wherein the inner annular optical system has a first finite thickness in a direction radial to the lamp axis and comprises two first inner areas, a second inner area separate from and adjacent to the two first inner areas and two third inner areas, each of the two third inner areas overlapping a respective one of the two first inner areas;

d) arranging an outer annular optical system concentrically around the lamp axis, wherein the outer annular optical system has a second finite thickness in the direction radial to the lamp axis and comprises two first outer areas, a second outer area separate from the two first outer areas and two third outer areas separate from the two first outer areas and the second outer area, the annular support element, the inner annular optical system and the outer annular optical system forming an optical arrangement;

e) arranging a plurality of lighting elements on the annular support element in an annular distribution around the lamp axis, wherein each of the plurality of lighting elements defines a respective polar plane including the lamp axis and intersecting a respective lighting element of the plurality of lighting elements and wherein the respective lighting element radiates light in the respective polar plane such that a portion of the light radiated in the respective polar plane is radiated within a central polar range containing a mean polar direction and a remainder of the light radiated in the respective polar plane is radiated outside the central polar range, the central polar range comprising a polar middle region containing the mean polar direction and two polar outside regions adjoining the polar middle region at either side;

f) shaping the annular reflector in such a manner that the light radiated by the respective lighting element in the central polar range is not reflected by the annular reflector, but passes first through the inner annular optical system, and then through the outer annular optical system;

g) shaping the annular reflector to reflect the light radiated by the respective lighting element outside the central polar range radially outwardly, such that the light radiated by the respective lighting element outside the central polar range and reflected by the annular reflector passes through the two first inner areas;

h) shaping the two first inner areas to direct the light reflected by the reflector and passing through the two first inner areas to the two first outer areas;

i) shaping the two first outer areas such that the light passing through the two first inner areas and directed to the two first outer areas emerges from the two first outer areas in a direction within a desired polar angular range around the mean polar direction;

j) shaping the inner annular optical system in such a manner that the light radiated by the respective lighting element within the polar middle region passes through the second inner area;

k) shaping the second inner area to direct the light passing through the second inner area to the second outer area;

l) shaping the second outer area such that the light passing through the second inner area and directed to the second outer area emerges from the second outer area in a direction within the desired polar angular range around the mean polar direction;

m) shaping the inner annular optical system in such a manner that the light radiated by the respective lighting element in the two polar outside regions passes through the two third inner areas;

n) shaping the two third inner areas to direct the light passing through the two third inner areas to the two third outer areas;

o) shaping the two third outer areas such that the light passing through the two third inner areas and directed to the two third outer areas emerges from the two third outer areas in a direction within the desired polar angular range around the mean polar direction; and p) arranging a respective separating web on the support element between each two adjacent lighting elements of the plurality of lighting elements, wherein the respective separating web extends in a radial direction from the two adjacent lighting elements to the inner annular optical system.

18. A method for constructing a lamp for radiating a warning signal within a desired polar angular range around a mean polar direction, the method comprising the steps of:

a) fixing a base body at a mounting location, the base body comprising a support flange and a cover;

b) arranging an annular support element comprising an annular reflector concentrically around a lamp axis;

c) arranging an inner annular optical system concentrically around the lamp axis, wherein the inner annular optical system has a first finite thickness in a direction radial to the lamp axis and comprises two first inner areas, a second inner area separate from and adjacent to the two first inner areas and two third inner areas, each of the two third inner areas overlapping a respective one of the two first inner areas;

d) arranging an outer annular optical system concentrically around the lamp axis, wherein the outer annular optical system has a second finite thickness in the direction radial to the lamp axis and comprises two first outer areas, a second outer area separate from the two first outer areas and two third outer areas separate from the two first outer areas and the second outer area, the annular support element, the inner annular optical system and the outer annular optical system forming an optical arrangement;

e) arranging a plurality of lighting elements on the annular support element in an annular distribution around the lamp axis, wherein each of the plurality of lighting elements defines a respective polar plane including the lamp axis and intersecting a respective lighting element of the plurality of lighting elements and wherein the respective lighting element radiates light in the respective polar plane such that a portion of the light radiated in the respective polar plane is radiated within a central polar range containing a mean polar direction and a remainder of the light radiated in the respective polar plane is radiated outside the central polar range, the central polar range comprising a polar middle region containing the mean polar direction and two polar outside regions adjoining the polar middle region at either side;

f) shaping the annular reflector in such a manner that the light radiated by the respective lighting element in the central polar range is not reflected by the annular reflector, but passes first through the inner annular optical system, and then through the outer annular optical system;

g) shaping the annular reflector to reflect the light radiated by the respective lighting element outside the central polar range radially outwardly, such that the light radiated by the respective lighting element outside the central polar range and reflected by the annular reflector passes through the two first inner areas;

h) shaping the two first inner areas to direct the light reflected by the reflector and passing through the two first inner areas to the two first outer areas;

i) shaping the two first outer areas such that the light passing through the two first inner areas and directed to the two first outer areas emerges from the two first outer areas in a direction within a desired polar angular range around the mean polar direction;

j) shaping the inner annular optical system in such a manner that the light radiated by the respective lighting element within the polar middle region passes through the second inner area;

k) shaping the second inner area to direct the light passing through the second inner area to the second outer area;

l) shaping the second outer area such that the light passing through the second inner area and directed to the second outer area emerges from the second outer area in a direction within the desired polar angular range around the mean polar direction;

m) shaping the inner annular optical system in such a manner that the light radiated by the respective lighting element in the two polar outside regions passes through the two third inner areas;

n) shaping the two third inner areas to direct the light passing through the two third inner areas to the two third outer areas;

o) shaping the two third outer areas such that the light passing through the two third inner areas and directed to the two third outer areas emerges from the two third outer areas in a direction within the desired polar angular range around the mean polar direction; and p) arranging the optical arrangement between the support flange and the cover as seen in the direction of the lamp axis.

19. The method according to claim 18, further comprising the steps of:

arranging layers of electrically insulating material between the support element and the base body in both a radial direction and an axial direction so that the support element is electrically insulated from the base body;

thermally coupling the plurality of lighting elements by way of the support element to at least one of the support flange and the cover; and arranging a plurality of cooling elements at least one of the support flange and at the cover for delivering heat produced by the plurality of lighting elements to the environment.

20. The method according to claim 18, further comprising the steps of providing at least one auxiliary optical arrangement constructed analogously to the optical arrangement and arranging the optical arrangement and the at least one auxiliary optical arrangement one above the other as seen in the direction of the lamp axis.

21. The method according to claim 20, further comprising the steps of mounting the optical arrangement at a first defined spacing from the support flange and mounting the auxiliary optical arrangement at a second defined spacing from the cover, as seen in the direction of the lamp axis.

22. The method according to claim 20, further comprising the step of arranging a resilient spacer between the respective support elements of the optical arrangement and the auxiliary optical arrangement as seen in the direction of the lamp axis.

23. The method according to claim 20, further comprising the steps of integrally connecting the outer annular optical system of the optical arrangement and the outer annular optical system of the auxiliary optical arrangement and mounting the outer annular optical system of the optical arrangement and the outer annular optical system of the auxiliary optical arrangement between the support flange and the cover.

* * * * *